US005742266A

United States Patent [19]

Onozuka

[11] Patent Number: 5,742,266

[45] Date of Patent: Apr. 21, 1998

[54] IMAGE DISPLAY DEVICE USING HIGH-VOLTAGE ELECTRODES AND METHOD OF DRIVING SAME

[75] Inventor: Kuniharu Onozuka, Kanagawa, Japan

[73] Assignee: Sony Corporation, Tokyo, Japan

[21] Appl. No.: 383,870

[22] Filed: Feb. 6, 1995

[30] Foreign Application Priority Data

Feb. 22, 1994 [JP] Japan ..... 6-024345

[51] Int. Cl.[6] ..... G09G 3/10; H01J 29/10

[52] U.S. Cl. ..... 345/74; 315/366; 313/422; 313/309

[58] Field of Search ..... 345/74, 208, 75, 345/96, 150, 207, 65; 315/366, 15; 313/422, 309, 456, 451, 495, 414

[56] References Cited

U.S. PATENT DOCUMENTS

| | | | |
|---|---|---|---|
| 3,930,120 | 12/1975 | Keller et al. | 178/7.7 |
| 4,654,649 | 3/1987 | Kojima et al. | 345/207 |
| 4,658,188 | 4/1987 | Bohmer | 315/366 |
| 4,816,724 | 3/1989 | Hamada et al. | 315/366 |
| 5,424,605 | 6/1995 | Lovoi | 313/422 |
| 5,488,386 | 1/1996 | Yamagishi et al. | 345/74 |
| 5,534,744 | 7/1996 | Leroux et al. | 313/309 |
| 5,541,473 | 7/1996 | Duboc, Jr. et al. | 313/422 |
| 5,569,973 | 10/1996 | Zimmerman | 313/309 |

*Primary Examiner*—Raymond J. Bayerl
*Assistant Examiner*—John Suraci
*Attorney, Agent, or Firm*—Jay H. Maioli

[57] ABSTRACT

An image display device has a control electrode which comprises an X-Y grid assembly composed of planar two-layer conductive grids which define electron passage holes at junctions thereof. The control electrode have capacitive bodies disposed at the junctions for storing a control voltage to control electrons emitted from a planar cathode and having passed through the electron passage holes. A high-voltage electrode applies a high voltage to a planar light emitting layer to attract the electrons that have passed through the electron passage holes and have been controlled by the control voltage, to the planar light emitting layer for emitting light in response to bombardment of the electrons thereon. The electrons are supplied at all times by the control electrode for continuous emission of light from the planar light emitting layer. Since the cathode and the electrodes are of a planar structure, the image display device is lightweight and of a low profile.

8 Claims, 28 Drawing Sheets

Energization of X-Y Grid Assembly
And Potential at Grid Hole GH

X Grid Drive Voltage
FIG. 4A-1 HD
FIG. 4A-2 X-1
FIG. 4A-3 X-2
FIG. 4A-4 X-3
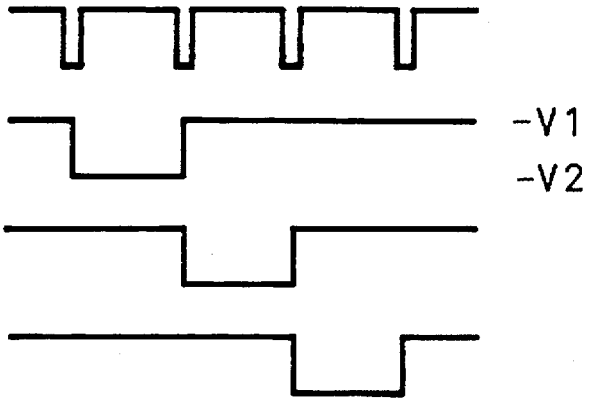
Y Grid Drive Voltage
FIG. 4B-1 Clock
FIG. 4B-2 Y-1
FIG. 4B-3 Y-2
FIG. 4B-4 Y-3
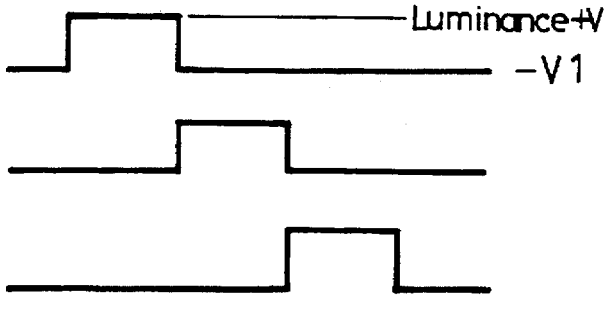

FIG. 18

P and N Layers are Provided According to GRID Number as Shown in Table Below. The Mark × Indicates No Contact (Conduction).

| Y Number | Binary Code | P·N Layer ○: Present ×: Not Present | | | | | | | | | | |
|---|---|---|---|---|---|---|---|---|---|---|---|---|
| | | $2^0$ | $\overline{2^0}$ | $2^1$ | $\overline{2^1}$ | $2^2$ | $\overline{2^2}$ | $2^3$ | $\overline{2^3}$ | $2^4$ | $\overline{2^4}$ | - - - - - |
| 1 | ---0001 | ○ | × | × | ○ | × | ○ | × | ○ | × | ○ | - - - - - |
| 2 | ---0010 | × | ○ | ○ | × | × | ○ | × | ○ | × | ○ | - - - - - |
| 3 | ---0011 | ○ | × | ○ | × | × | ○ | × | ○ | × | ○ | - - - - - |
| 4 | ---0100 | × | ○ | × | ○ | ○ | × | × | ○ | × | ○ | - - - - - |
| 5 | ---0101 | ○ | × | × | ○ | ○ | × | × | ○ | × | ○ | - - - - - |
| 6 | ---0110 | × | ○ | ○ | × | ○ | × | × | ○ | × | ○ | - - - - - - |
| 7 | ---0111 | ○ | × | ○ | × | ○ | × | × | ○ | × | ○ | - - - - - |
| 8 | ---1000 | × | ○ | × | ○ | × | ○ | ○ | / | × | ○ | - - - - - - |

FIG. 20

| X Number | Binary Code | P·N Layer ○: Present ×: Not Present | | | | | | | | | | | | | |
|---|---|---|---|---|---|---|---|---|---|---|---|---|---|---|---|
| | | $2^0$ | $\overline{2^0}$ | $2^1$ | $\overline{2^1}$ | $2^2$ | $\overline{2^2}$ | $2^3$ | $\overline{2^3}$ | $2^4$ | $\overline{2^4}$ | - | - | - | - |
| 1 | ---0001 | × | ○ | ○ | × | ○ | × | ○ | × | ○ | × | - | - | - | - |
| 2 | ---0010 | ○ | × | × | ○ | ○ | × | ○ | × | ○ | × | - | - | - | - |
| 3 | ---0011 | × | ○ | × | ○ | ○ | × | ○ | × | ○ | × | - | - | - | - |
| 4 | ---0100 | ○ | × | ○ | × | × | ○ | ○ | × | ○ | × | - | - | - | - |
| 5 | ---0101 | × | ○ | ○ | × | × | ○ | ○ | × | ○ | × | - | - | - | - |
| 6 | ---0110 | ○ | × | × | ○ | × | ○ | ○ | × | ○ | ○ | - | - | - | - |
| 7 | ---0111 | × | ○ | × | ○ | × | ○ | ○ | × | × | × | - | - | - | - |

IMAGE DISPLAY DEVICE USING HIGH-VOLTAGE ELECTRODES AND METHOD OF DRIVING SAME

BACKGROUND OF THE INVENTION

1. Field of the Invention

The present invention relates to an image display device suitable for use as a display unit in a television receiver, a video projector, or the like, and a method of driving such an image display device.

2. Description of the Related Art

Cathode-ray tubes (CRTs) have heretofore been used most widely as devices for displaying images. Since CRTs are of the beam scan type which employs an electron beam to scan a phosphor panel, they require a physical space to deflect the electron beam therein.

CRTs which are of the beam scan type emit light from a phosphor for a period of time due to the afterglow of the phosphor. Consequently, the period of light emission depends on the afterglow of the phosphor. After the electron beam has passed, the CRTs produce brightness obtained by the afterglow of the phosphor. Therefore, the CRTs are unable to produce images of high brightness.

In the CRTs, the electron beam is electromagnetically deflected. Therefore, the CRTs are susceptible to the earth's magnetism, and tend to produce registration distortions. Furthermore, the CRTs require a high-voltage power supply for attracting the electron beam.

There have been developed liquid crystal display devices with thin display panels for replacing the CRTs. The liquid crystal display devices, however, effectively utilize transmissive light by several %, e.g., 4 to 5% if they use a single display panel. The liquid crystal display devices have a light source whose photoelectric conversion efficiency is low, i.e., about 30%. Therefore, they need a light source having a high power requirement in order to provide an image screen of high brightness.

The liquid crystal display devices are also disadvantageous in that the process of fabricating liquid crystals is highly complex and the equipment used in the process of fabricating liquid crystals is very costly. Additionally, the liquid crystal display devices are susceptible to ambient temperatures because they are structurally unstable and they are degraded in a temperature range of from 60 to 80 degrees centigrade.

OBJECTS AND SUMMARY OF THE INVENTION

It is therefore an object of the present invention to provide an image display device with a thin profile for producing images of high brightness and a method of driving such an image display device.

According to the present invention, there is provided an image display device comprising a planar cathode for emitting electrons from an entire planar surface thereof, a control electrode composed of planar two-layer conductive grids which define electron passage holes at junctions thereof, the control electrode having capacitive bodies disposed at the junctions for storing a control voltage to control the electrons emitted from the planar cathode and having passed through the electron passage holes, a planar light emitting layer, and a high-voltage electrode for applying a high voltage to the planar light emitting layer to attract the electrons that have passed through the electron passage holes and have been controlled by the control voltage, to the planar light emitting layer for emitting light in response to bombardment of the electrons thereon.

The planar cathode, the control electrode, and the high-voltage electrode jointly constitute a triode.

The image display device may further comprise an accelerating electrode disposed between the control electrode and the high-voltage electrode for accelerating the electrons; the planar cathode, the control electrode, the accelerating electrode, and the high-voltage electrode jointly constituting a tetrode.

The image display device may further comprise a convergence electrode for converging the electrons and an adjusting electrode for adjusting the direction of the electrons, the convergence electrode and the adjusting electrode being disposed between the control electrode and the high-voltage electrode; the planar cathode, the control electrode, the convergence electrode, the adjusting electrode, and the high-voltage electrode jointly constituting a tetrode.

The image display device may further comprise an auxiliary cathode disposed as a coated layer of magnesium oxide on the planar cathode, wherein a negative voltage is applied to the planar cathode to emit secondary electrons from the auxiliary cathode for increasing an amount of emitted electrons.

According to the present invention, there is also provided a method of driving an image display device, comprising the steps of applying a medium-potential sawtooth drive voltage having a minimum potential of zero volt to a planar cathode for emitting electrons from an entire planar surface thereof, applying a low-potential voltage of at least a negative level to a control electrode composed of planar two-layer conductive grids which define electron passage holes at junctions thereof, the control electrode having capacitive bodies disposed at the junctions, to control the electrons emitted from the planar cathode and having passed through the electron passage holes, and applying a flat high-potential voltage to a high-voltage electrode to attract the electrons which have passed through the electron passage holes.

The above and other objects, features, and advantages of the present invention will become apparent from the following description of illustrative embodiments thereof to be read in conjunction with the accompanying drawings, in which like reference numerals represent the same or similar objects.

BRIEF DESCRIPTION OF THE DRAWINGS

FIG. 4A is a diagram showing drive voltages applied to an X grid;

FIG. 4B is a diagram showing drive voltages applied to a Y grid;

FIG. 18 is a diagram illustrative of operation of a Y grid of the binary-address-input grid-charge display device according to the fourteenth embodiment of the present invention;

FIG. 20 is a diagram illustrative of operation of an X grid of the binary-address-input grid-charge display device according to the fourteenth embodiment of the present invention;

DETAILED DESCRIPTION OF THE PREFERRED EMBODIMENTS

Figure 1A:
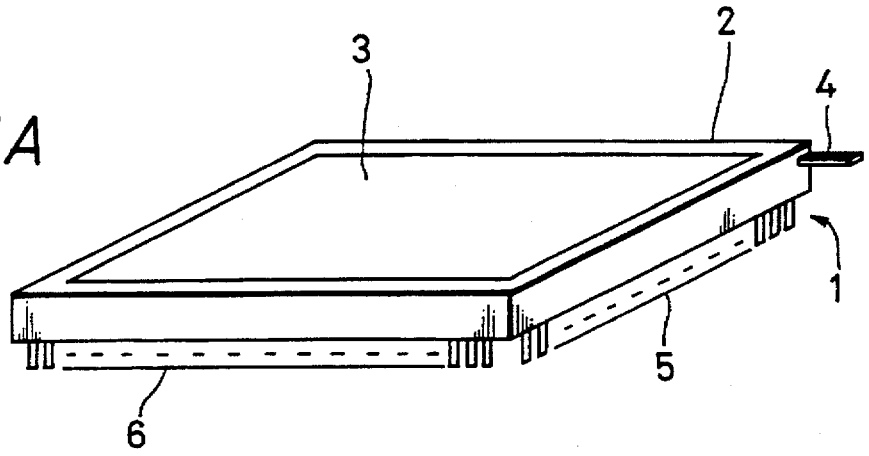
FIGS. 1A and 1B are perspective views of a grid-charge display device and a binary-address-input grid-charge display device, respectively, as an image display device according to a first embodiment of the present invention.

FIG. 1A shows a grid-charge display device as an image display device according to a first embodiment of the present invention. As shown in FIG. 1A, the grid-charge display device, generally denoted by 1, has a rectangular frame 2 and a planar display panel 3 surrounded by and attached to an upper end of the frame 2. An anode 4 is connected to the display panel 3 for applying a high voltage to the display panel 3.

X and Y grids 5, 6 are attached to a lower end of the frame 2 and extend along the outer edges of two sides of the frame 2. The X and Y grids 5, 6 serve as control electrodes for controlling electrons which are supplied from the surface of a cathode (not shown).

Figure 1B:
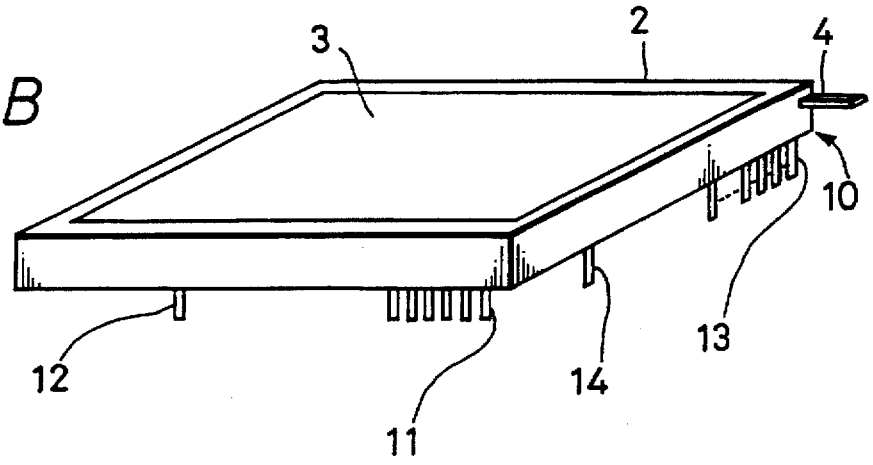

FIG. 1B shows a binary-address-input grid-charge display device also as an image display device according to the first embodiment of the present invention. The binary-address-input grid-charge display device shown in FIG. 1B is a specific version of the grid-charge display device shown in FIG. 1A. As shown in FIG. 1B, the binary-address-input grid-charge display device, generally denoted by 10, has a rectangular frame 2 and a planar display panel 3 surrounded by and attached to an upper end of the frame 2. An anode 4 is connected to the display panel 3 for applying a high voltage to the display panel 3. An X address grid 11 and a reference voltage terminal 12, and an Y address grid 13 and an input terminal 14 are attached to an lower end of the frame 2 and extend along the outer edges of two sides of the frame 2.

The binary-address-input grid-charge display device 10 shown in FIG. 1B differs from the grid-charge display device 1 shown in FIG. 1A in that coordinates for charging a control voltage can be input with a binary code through the X address grid 11, the reference voltage terminal 12, the Y address grid 13, and the input terminal 14.

Figure 2A:
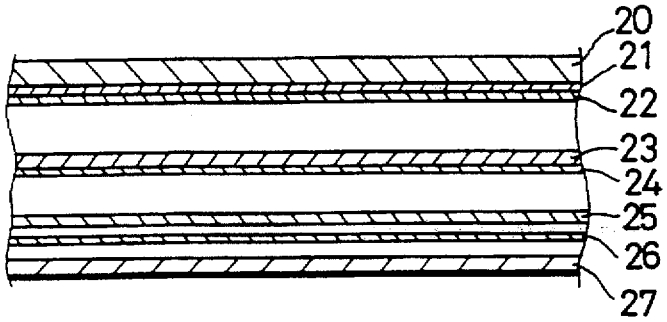
FIG. 2A is a fragmentary cross-sectional view of a grid-charge display device as an image display device according to a second embodiment of the present invention.
Figure 2B:
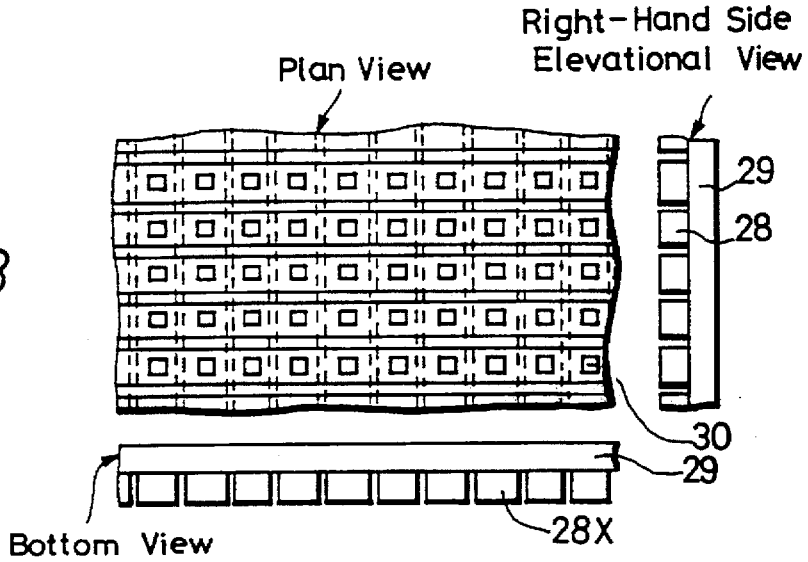
FIG. 2B is a set of plan, right-hand side elevational, and bottom views of an X-Y grid structure of the grid-charge display device shown in FIG. 2A.
Figure 2C:
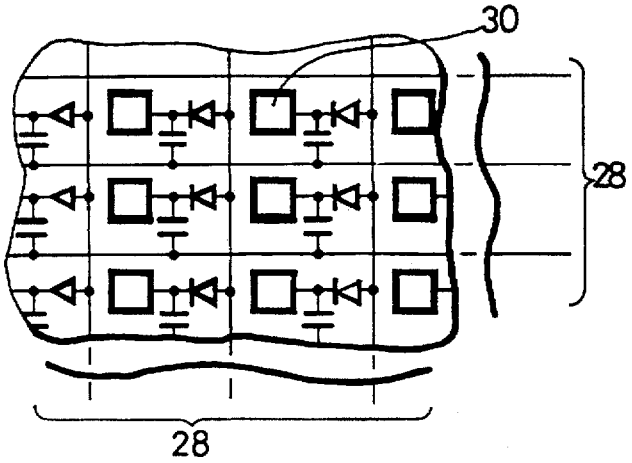
FIG. 2C is a fragmentary circuit diagram of an equivalent circuit of the X-Y grid assembly shown in FIG. 2B.

FIGS. 2A, 2B, and 2C show a grid-charge display device as an image display device according to a second embodiment of the present invention. As shown in FIG. 2A, the grid-charge display device includes a face glass panel 20 on its top and a phosphor layer 21 disposed underneath the surface glass panel 20 and sandwiched between the face glass panel 20 and an anode 22.

The grid-charge display device also includes a convergence grid 23 spaced a certain distance from the anode 22 and an X-Y grid assembly 24 disposed underneath the convergence grid 23. The grid-charge display device also includes a cathode 25 spaced a certain distance from the X-Y grid assembly 24, a heater 26 spaced a certain distance from the cathode 25, and a back glass panel 27 spaced a certain distance from the heater 26 and disposed on the lowermost side of the display device. Each of the above components of the grid-charge display device is of a planar shape. The components of the grid-charge display device are sealed in a vacuum. Light emitted by the grid-charge display device is discharged through the face glass panel 20.

FIG. 2B show the X-Y grid assembly 24 in detail. The X-Y grid assembly 24 comprises an X grid 28 and a Y grid 29, each in the form of a planar grid. The X and Y grids 28, 29 are combined with each other in orthogonal relation, defining electron passage holes (grid holes 30 at junctions thereof.

FIG. 2C shows an equivalent circuit of the X-Y grid assembly 24. The junctions of the X and Y grids 28, 29 are composed of the electron passage holes 30, capacitors C as capacitive bodies, and diodes D.

Figure 3A:
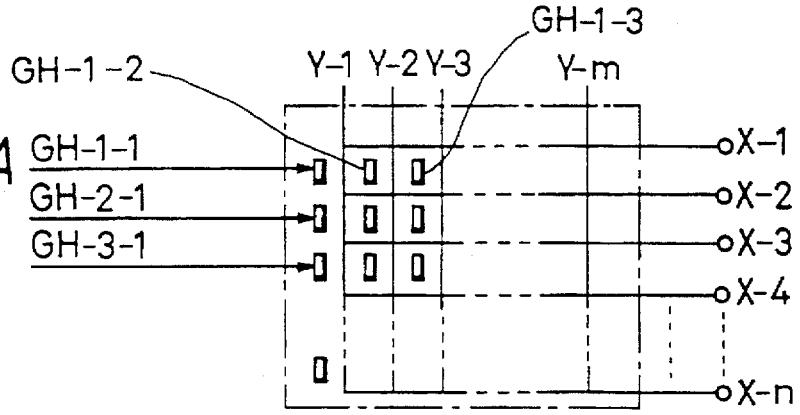
FIG. 3A is a view of the X-Y grid assembly and grid holes GH, showing the manner in which the grid-charge display device according to the second embodiment operates.
Figures 1, 3B:
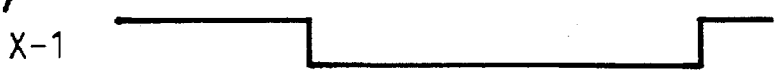
FIG. 3B is a diagram showing energization of the X-Y grid assembly and potentials at grid holes GH.
Figures 2, 3B:
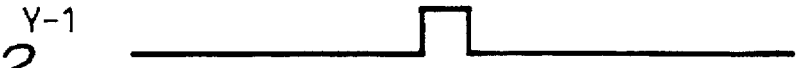
Figures 3, 3B:
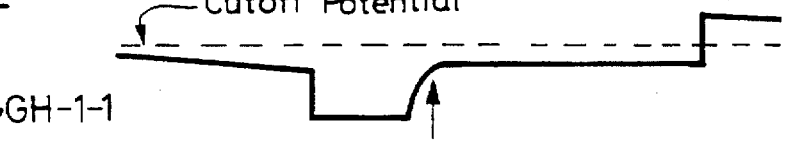

Operation of the grid-charge display device according to the second embodiment will be described below with reference to FIGS. 3A through 3C. In FIG. 3A, the X grid has X grid lines X-1, X-2, X-3, X-4, . . . , X-n and the Y grid has Y grid lines Y-1, Y-2, Y-3, Y-4, . . . , Y-n. The junctions between these X grid lines X-1, X-2, X-3, X-4, . . . , X-n and Y grid lines Y-1, Y-2, Y-3, Y-4, . . . , Y-n have respective electron passage holes GH-1-1, GH-1-2, GH-1-3, . . . arrayed along the X grid lines and respective electron passage holes GH-1-1, GH-2-1, GH-3-1, . . . arrayed along the Y grid lines. One of the X grid lines and one of the Y grid lines are sampled at a time, and an active potential is applied to the sampled X and Y grid lines.

Drive voltages shown in FIGS. 4A and 4B are applied to the X and Y grid lines shown in FIG. 3A. Drive voltages are applied to the X grid line X-1 and the Y grid line Y-1, and a potential is developed at the electron passage hole (grid hole) GH-1-1 as shown in FIG. 3B. Specifically, when the drive voltage is applied to the Y grid line Y-1, the electron passage hole GH-1-1 is charged up to a voltage or potential which is equal to the difference between the drive voltage applied to the X grid line X-1 and the drive voltage applied to the Y grid line Y-1. If a voltage corresponding to a desired brightness, i.e., an input signal, is applied to the Y grid line Y-1, the electron passage hole GH-1-1 is charged up to a potential corresponding to the brightness.

Figure 3C:
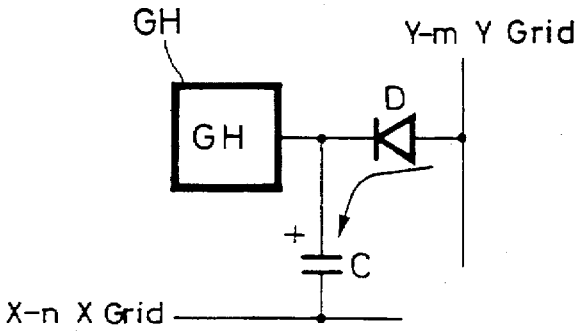
FIG. 3C is a fragmentary circuit diagram of an equivalent circuit of the X-Y grid assembly and grid holes GH.

FIG. 3C shows an equivalent circuit of the junction between an X grid line X-n and a Y grid line Y-m. An electron passage hole GH at the junction is charged as follows: A voltage applied to the Y grid line Y-m passes through a diode D and is charged in a capacitor C. The capacitor C stores the sum of a voltage applied to the X grid line X-n and the voltage applied to the Y grid line Y-m. The electric charge stored in the capacitor C appears in the electron passage hole GH when the X grid line X-n switches to a positive potential. In response to the potential applied to the electron passage hole GH, the electron passage hole GH allows electrons to pass therethrough beyond a cutoff potential.

The electrons that have passed through the electron passage hole GH are accelerated by a high voltage applied to the anode, and pass through the anode into collision with the phosphor layer, enabling the phosphor layer to emit light.

Figure 5:
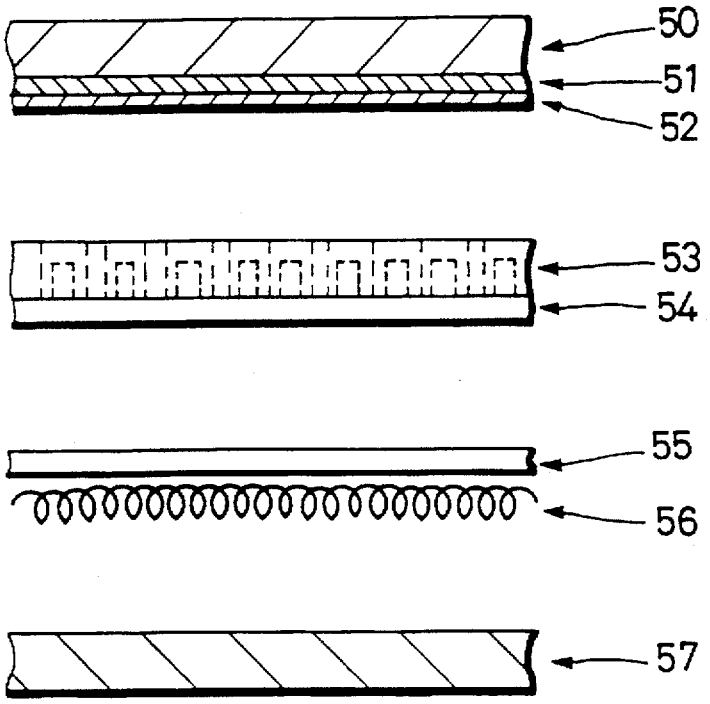
FIG. 5 is an exploded fragmentary cross-sectional view of a grid-charge display device of triode structure as an image display device according to a third embodiment of the present invention.

FIG. 5 shows in cross section a grid-charge display device of triode structure as an image display device according to a third embodiment of the present invention. As shown in FIG. 5, the grid-charge display device has a face glass panel 50 on its top and a phosphor layer 51 disposed underneath the surface glass panel 50 and sandwiched between the face glass panel 50 and a high-voltage electrode 52 which comprises a metal back member serving as an anode.

The grid-charge display device also includes an X grid 53 and a Y grid 54 which are spaced a certain distance from the high-voltage electrode 52, a cathode 55 spaced a certain distance from the X and Y grids 53, 54, a heater 56 spaced a certain distance from the cathode 55, and a back glass panel 57 spaced a certain distance from the heater 56 and disposed on the lowermost side of the display device. Each of the above components of the grid-charge display device is of a planar shape. The high-voltage electrode 52, a control electrode composed of the X and Y grids 53, 54, and the cathode 55 jointly constitute a triode structure.

Figure 6:
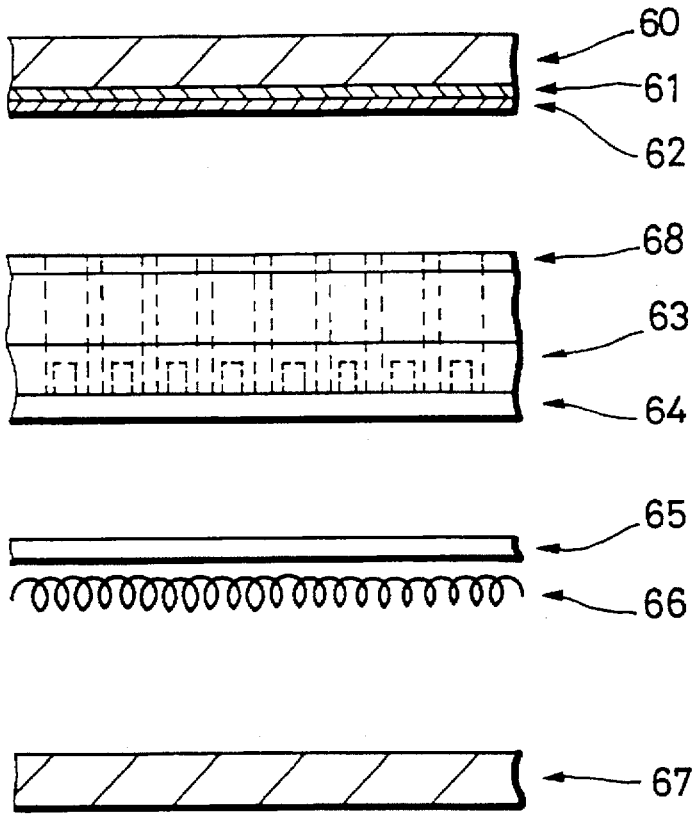
FIG. 6 is an exploded fragmentary cross-sectional view of a grid-charge display device of multielectrode tube structure as an image display device according to a fourth embodiment of the present invention.

FIG. 6 shows in cross section a grid-charge display device of multielectrode tube structure as an image display device according to a fourth embodiment of the present invention. The grid-charge display device shown in FIG. 6 differs from the grid-charge display device shown in FIG. 5 in that it additionally includes a convergence electrode 68 spaced a certain distance from a high-voltage electrode 62 and disposed upwardly of X and Y grids 63, 64. Each of the components of the grid-charge display device is of a planar shape. The high-voltage electrode 62, the convergence electrode 68, a control electrode composed of the X and Y grids 63, 64, and a cathode 65 jointly constitute a tetrode structure.

In each of the embodiments shown in FIGS. 5 and 6, all the electrodes are sealed in a vacuum. Light emitted by the grid-charge display device is discharged through the face glass panel. In the embodiment shown in FIG. 6, the convergence electrode may be replaced with an accelerating electrode or an alignment electrode.

In each of the above embodiments, an auxiliary cathode may be disposed as a coated layer of magnesium oxide on the cathode, and a negative voltage may be applied to the cathode to cause the auxiliary cathode to emit secondary electrons thereby to increase the amount of emitted electrons. With such a modification, the electron density around the cathode can be made uniform for increasing the quantity of emitted electrons.

Figure 7:
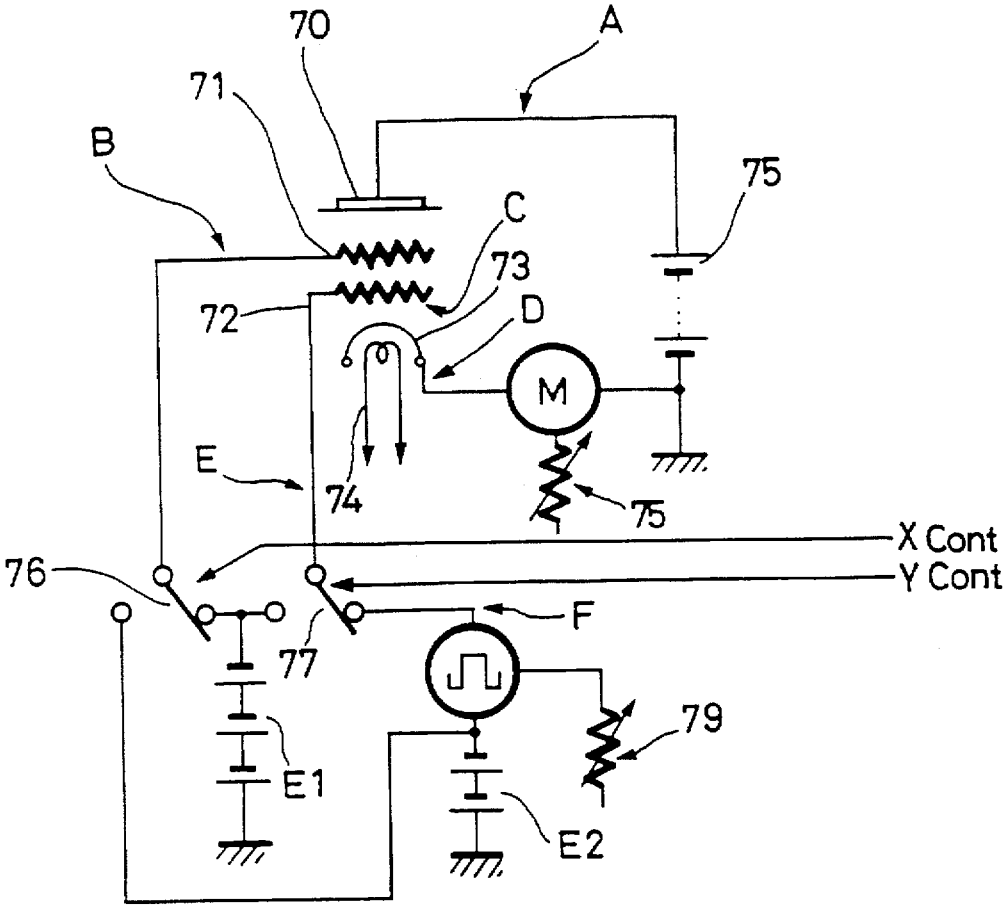
FIG. 7 is a circuit diagram showing the manner in which a grid-charge display device of triode structure as an image display device according to a fifth embodiment of the present invention operates.

Operation of a grid-charge display device of triode structure as an image display device according to a fifth embodiment of the present invention will be described below with reference to FIGS. 7 and 8. Potentials at points A~F in FIG. 7 are indicated by A~F, respectively, in FIG. 8. A high voltage A is applied from a high-voltage power supply 75 to an anode 70 which comprises a phosphor layer. The high voltage A is required to be sufficiently high to obtain a desired brightness.

An X grid 71 can be switched by an X switch 76 between an active state in which a higher voltage from a high-voltage power supply E1 is applied to the X grid 71 and a normal state in which a lower voltage from a low-voltage power supply E2 is applied to the X grid 71. Similarly, a Y grid 72 can be switched by a Y switch 77 between an active state in which the higher voltage from the high-voltage power supply E1 is applied to the Y grid 72 and a normal state in which the lower voltage from the low-voltage power supply E2 is applied to the Y grid 72. The X and Y switches 76, 77 can be shifted respectively by an X control signal X-CONT and a Y control signal Y-CONT. When the Y grid 72 is switched to the normal state by the Y switch 77, the contrast of an image displayed by the grid-charge display device can be adjusted by a contrast adjuster 79.

A cathode 73 can be heated by a heater 74. The brightness of the displayed image can be adjusted by a brightness adjuster 78 connected to the cathode 73. A saw-tooth drive voltage D, which has a minimum potential of about 0 volt, is applied to the cathode 73. A signal potential F is sampled by an active potential E applied to the Y grid 72, and the sampled potential is used as a charge potential C. An active potential B' applied to the X grid 71 and a normal potential E' applied to the Y grid 72 are of the same potential, which is sufficiently low, and the charge potential C is stored per pixel by electric charges flowing from the signal potential F into the potentials B', E' The charge potential C is self-discharged until it is charged next time. The discharge time of the charge potential C can be adjusted in a certain range by the normal potential E' applied to the Y grid 72.

Figure 8A:
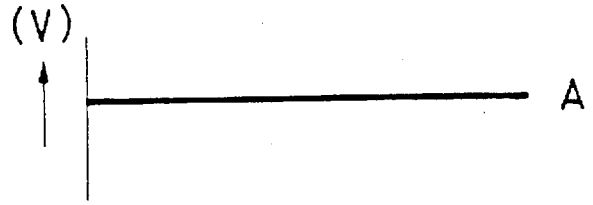
FIG. 8 is a diagram showing the manner in which the grid-charge display device of triode structure according to the fifth embodiment operates.
Figure 8B:
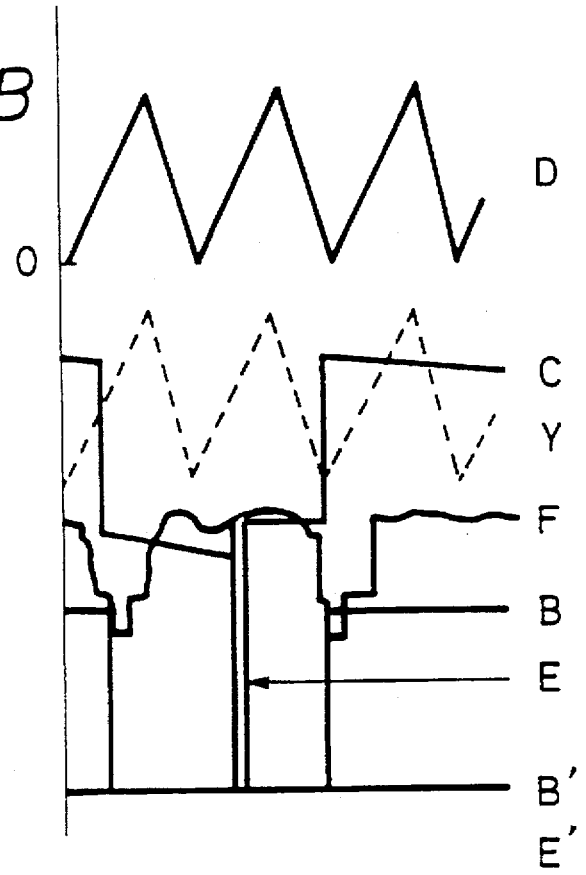
Figure 8C:
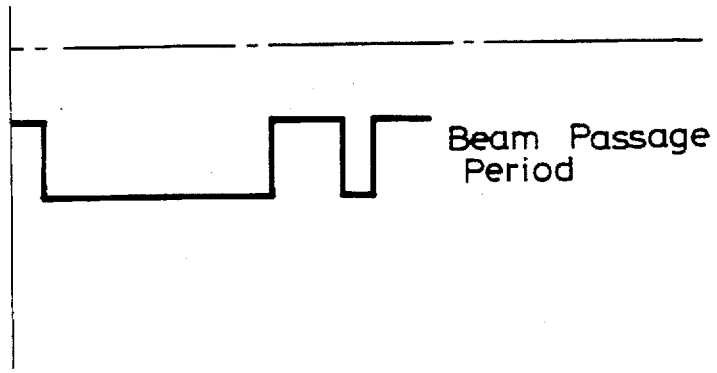

When a beam cutoff potential Y applied to the Y grid 72, which is indicated by the dotted-line curve in FIG. 8, is reached, it cuts off the electron beam. A normal potential B applied to the X grid 71 is kept in the vicinity of the beam cutoff potential Y for reducing effects on the signal potential F. The normal potential B serves to determine a base for brightness.

Figure 9:
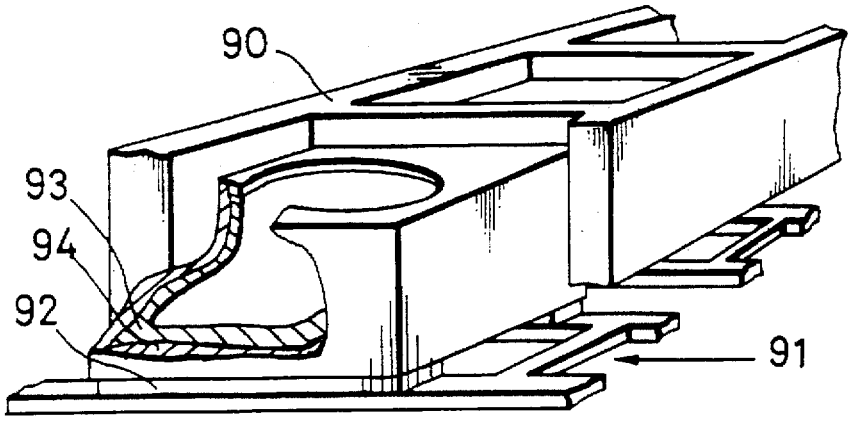
FIG. 9 is a perspective view, partly broken away, of an X-Y grid assembly of a grid-charge display device as an image display device according to a sixth embodiment of the present invention.
Figure 10:
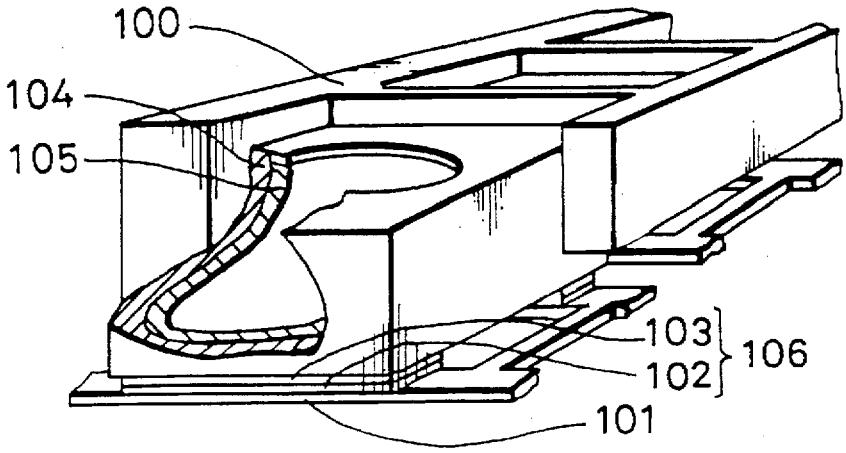
FIG. 10 is a perspective view, partly broken away, of an X-Y grid assembly of a grid-charge display device as an image display device according to a seventh embodiment of the present invention.
Figure 11:
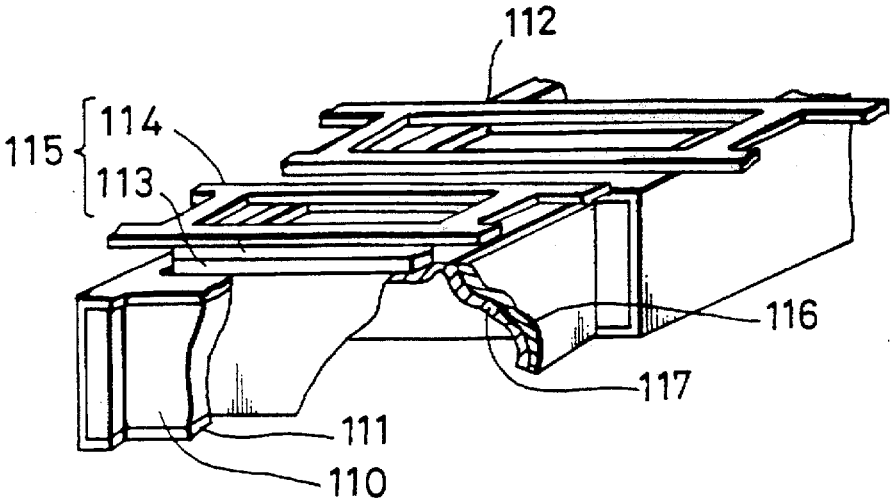
FIG. 11 is a perspective view, partly broken away, of an X-Y grid assembly of a grid-charge display device as an image display device according to an eighth embodiment of the present invention.

FIGS. 9, 10, and 11 show X-Y grid structures of grid-charge display devices as image display devices according to sixth, seventh, and eighth embodiments, respectively, of the present invention.

In FIG. 9, an N-type semiconductor 93 is used as an electrode of a capacitor which serves as a capacitive body. A capacitor is produced between a P-type semiconductor 92 and an X grid 90, and the N-type semiconductor 93 serves as an electrode of the capacitor. The X grid 90 and a Y grid 91 are made of a good electric conductor. A dielectric 94 is sandwiched between the N-type semiconductor 93 and the P-type semiconductor 92, thereby providing a diode.

In FIG. 10, a capacitor electrode is composed of a good conductor 105 to which there is attached a diode layer 106 that comprises an N-type semiconductor 103 and a P-type semiconductor 102. The good conductor 105 is surrounded by a dielectric 104. An X grid 100 comprises a good conductor having an insulated surface, and a Y grid 101 comprises a good conductor.

In FIG. 11, a capacitor electrode is composed of a good conductor 117 surrounded by a dielectric 116. An X grid 110 is covered with an insulating layer 111. A diode layer 115 which comprises an N-type semiconductor 113 and a P-type semiconductor 114 is attached to the good conductor 117. A Y grid 112 comprises a good conductor. The arrangement shown in FIG. 11 differs from that shown in FIG. 10 in that the diode layer 115 and the Y grid 112 are disposed on an opposite side of a cathode (not shown).

Figure 12A:
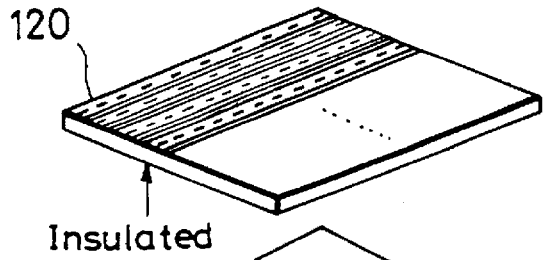
FIGS. 12A through 12G are views showing a process of manufacturing an X-Y grid assembly of a grid-charge display device as an image display device according to a ninth embodiment of the present invention.
Figure 12B:
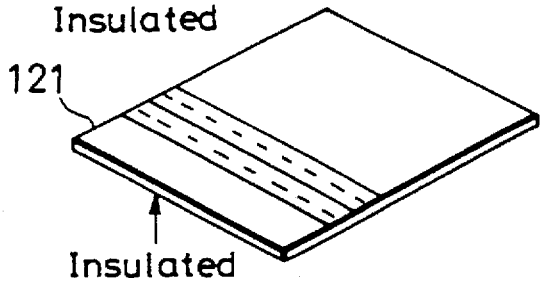

FIGS. 12A through 12G show a process of manufacturing an X-Y grid structure of a grid-charge display device as an image display device according to a tenth embodiment of the present invention. As shown in FIG. 12A, one surface of a plate made of copper, aluminum, or the like is insulated, and the other surface thereof is coated with a photoresist, producing an X grid 120. In FIG. 12B, one surface of a plate made of copper, aluminum, or the like is insulated, and the other surface thereof is coated with a photoresist, producing a Y grid 121.

Figure 12C:
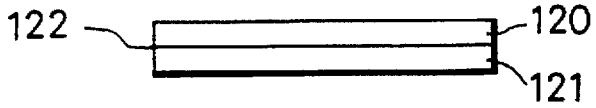
Figure 12D:
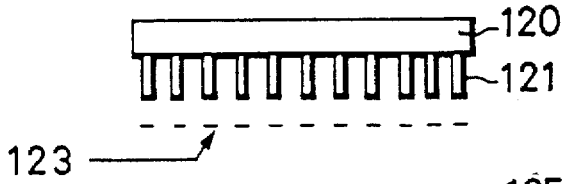

In FIG. 12C, the insulated surface of the X grid 120 shown in FIG. 12A and the insulated surface of the Y grid 121 shown in FIG. 12B are held against each other, and bonded with each other with an insulating layer 122 therebetween. As shown in FIG. 12D, only the outer surface of the Y grid 121 is etched, and the tip end of the etched surface is masked by a mask sheet 123. The tip end of the etched surface may be masked by a coated resist.

Figure 12E:
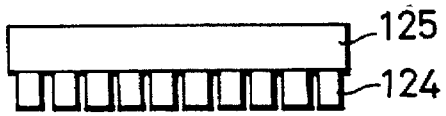
Figure 12F:
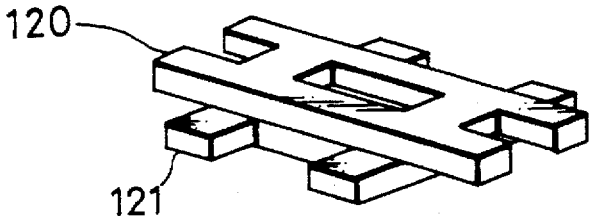
Figure 12G:
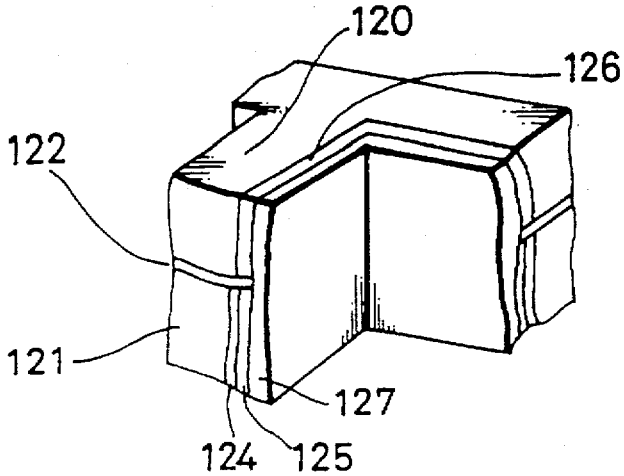

In FIG. 12E, a P-type layer 124 is evaporated on the Y grid 121, and an N-type layer 125 is evaporated on the X grid 120. In FIG. 12F, the X grid 120 is etched, and the tip end of the etched surface is masked. When the X grid 120 is etched, N- and P-type layers remaining on the bottom are removed. In FIG. 12G, a dielectric layer 126 is coated on the X grid 120, and then a good conductor layer 127 is coated thereon. Finally, the mask is removed.

Figure 13A:
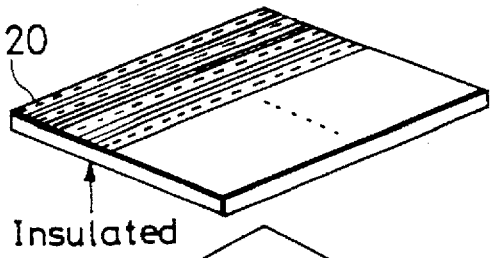
FIGS. 13A through 13G are views showing a process of manufacturing an X-Y grid assembly of a grid-charge display device as an image display device according to a tenth embodiment of the present invention.
Figure 13B:
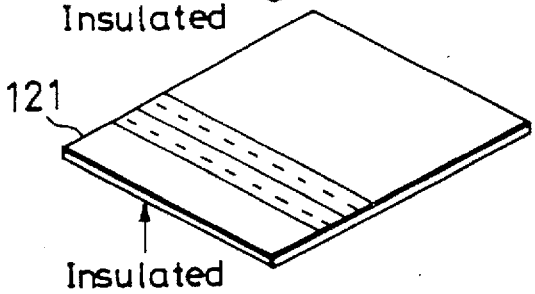
Figure 13C:
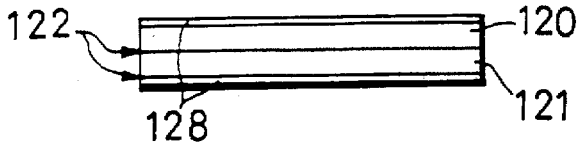
Figure 13D:
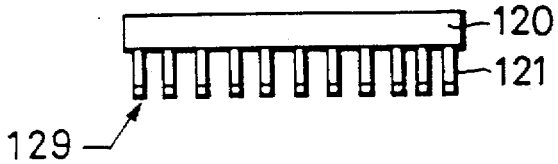
Figure 13E:
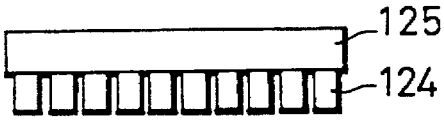
Figure 13F:
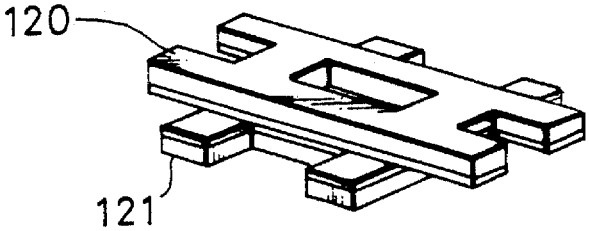
Figure 13G:
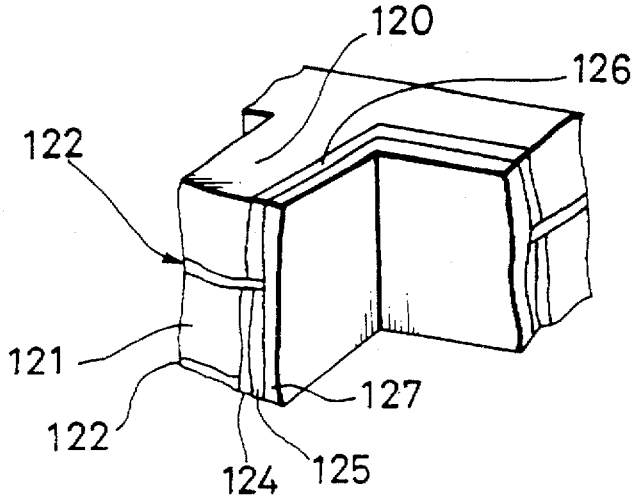

FIGS. 13A through 13G show a process of manufacturing an X-Y grid assembly of a grid-charge display device as an image display device according to a tenth embodiment of the present invention. The process shown in FIGS. 13A through 13G differs from the process shown in FIGS. 12A through 12G with respect to three points as follows: First, both surfaces of a plate made of copper, aluminum, or the like are insulated, and one of the surfaces is coated with a photoresist, producing a Y grid 121. Secondly, as shown in FIG. 13C, the insulated surface of an X grid 120 shown in FIG. 13A and the insulated surface of the Y grid 121 shown in FIG. 13B are held against each other, and bonded to each other with an insulating layer 122 therebetween, and a photosensitive layer 128 is formed on the lowermost surface of an insulating layer 122 on the lower surface of the assembly. Thirdly, as shown in FIG. 13D, only the Y grid 121 is etched, and the tip end of the etched surface is coated with a resist, producing a resist mask 129.

Figure 14:
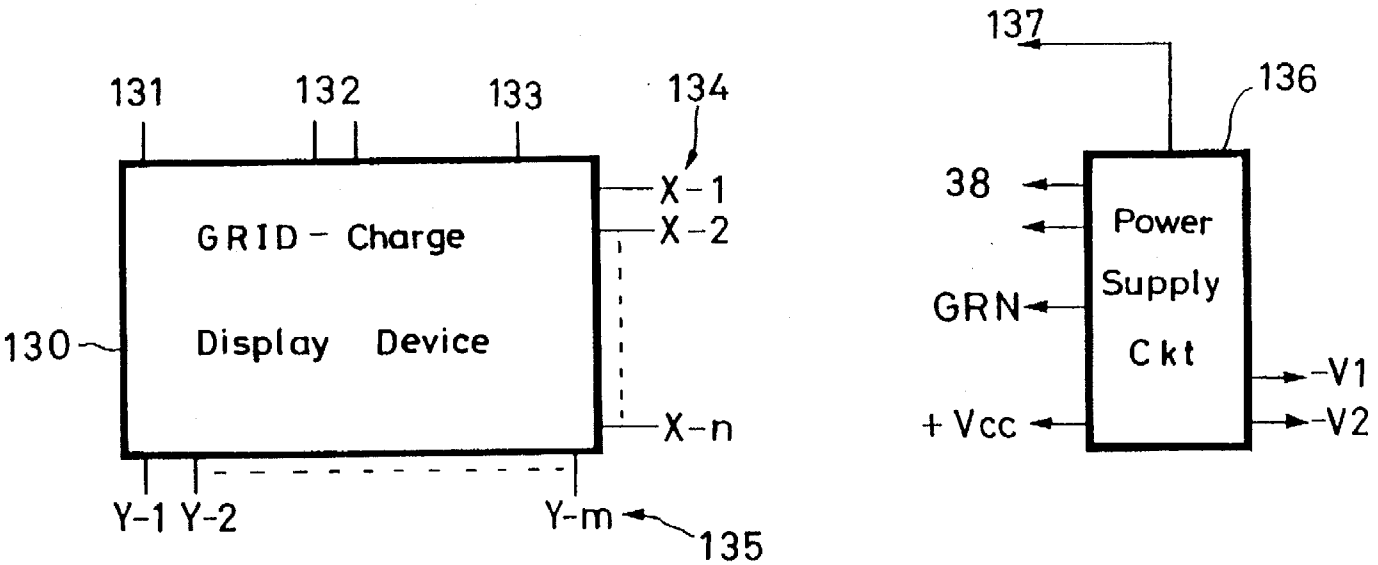
FIG. 14 is a block diagram of a television monitor which incorporates a grid-charge display device as an image display device according to an eleventh embodiment of the present invention.

FIG. 14 shows in block form a television monitor which incorporates a grid-charge display device as an image display device according to an eleventh embodiment of the present invention. As shown in FIG. 14, the grid-charge display device, indicated by 130, has a high-voltage input terminal 131, heater input terminals 132, a cathode input terminal 133, X grid input terminals 134, and Y grid input terminals 135. A power supply circuit 136 has a high-voltage output terminal 137, heater power supply output terminals 138, a ground terminal GRN, a power supply voltage terminal +VCC, a reference voltage terminal −V1, and a reference voltage terminal −V2.

Figure 15:
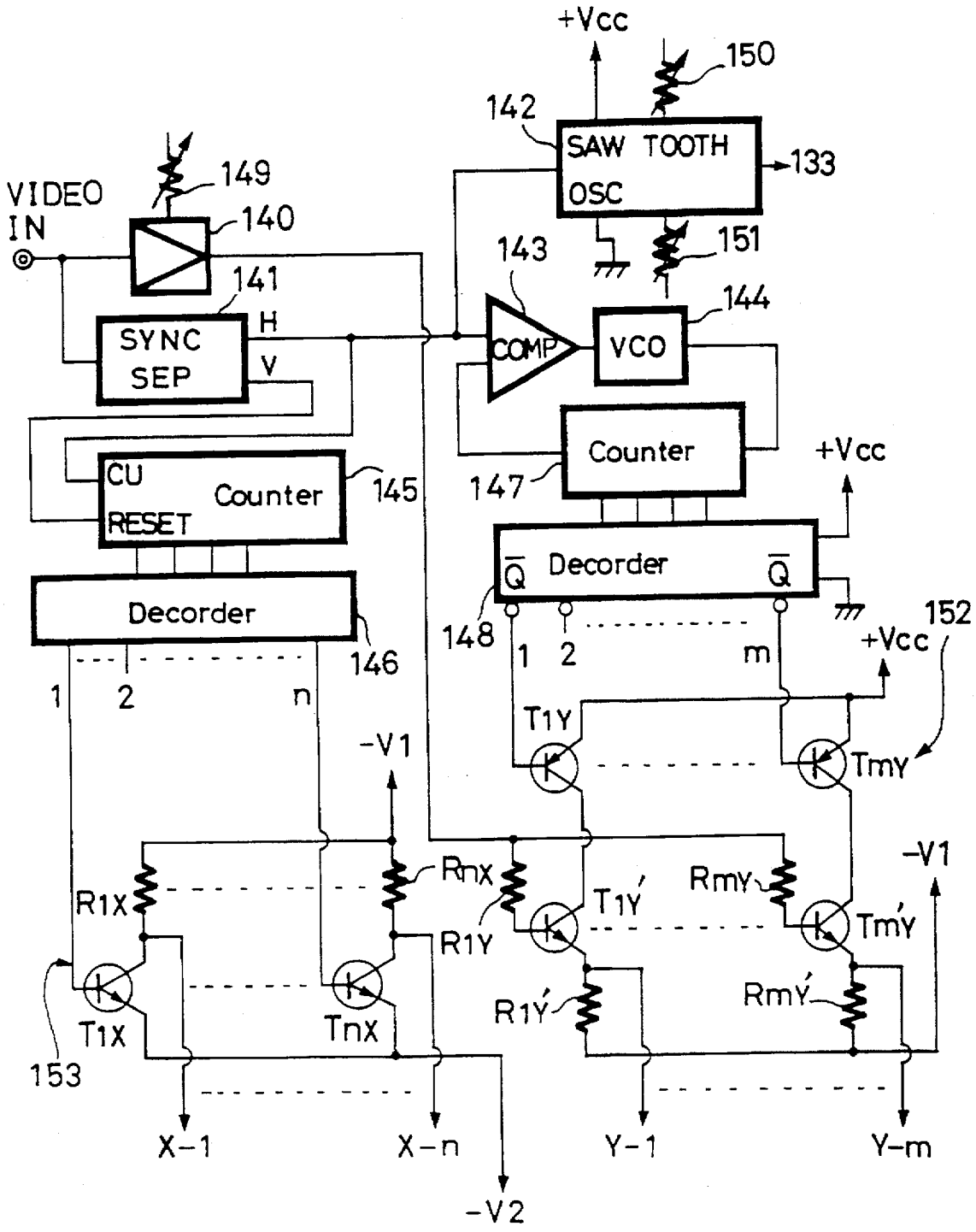
FIG. 15 is a circuit diagram of a driving circuit of a television monitor which incorporates a grid-charge display device as an image display device according to a twelfth embodiment of the present invention.

FIG. 15 shows a driving circuit of a television monitor which incorporates a grid-charge display device as an image display device according to a twelfth embodiment of the present invention. As shown in FIG. 15, a video signal supplied from a video signal input terminal VIDEO IN is amplified by an amplifier 140, impedance-converted by a Y drive circuit 152, and then supplied to Y grid input terminals 135 (see FIG. 14). The amplification factor of the amplifier 140 can be adjusted by an adjuster 149. The Y drive circuit 152 comprises an emitter-follower drive circuit including a plurality of PNP transistors $T_{1Y}, \ldots, T_{mY}$ having respective bases supplied with an output signal from a decoder 148 and respective emitters connected to a power supply voltage terminal +VCC for pull-up, and a plurality of NPN transistors $T_{1Y}', \ldots, T_{mY}$, having respective bases supplied with the output signal from the amplifier 140 through respective resistors $R_{1Y}, \ldots, R_{mY}$, respective collectors connected to the respective collectors of the PNP transistors $T_{1Y}, \ldots, T_{mY}$, and respective emitters connected to the Y grid input terminals 135 and also to a reference voltage terminal −V1 through respective resistors $R_{1Y}', \ldots, R_{mY}'$ for pull-down.

The video signal is also supplied to a synchronizing signal separator 141 which separates a horizontal synchronizing signal H and a vertical synchronizing signal V. The horizontal synchronizing signal H is applied to one of the input terminals of a phase comparator 143 whose output signal is supplied through a voltage-controlled oscillator 144 and a counter 147 to the other input terminal of the phase comparator 143. The counter 147 applies its count output signal to the decoder 148.

The horizontal synchronizing signal H is also supplied to a sawtooth oscillator 142 in which the brightness is adjusted by a brightness adjuster 150 and the γ curve is adjusted by a γ adjuster 151 to correct the linearity of a generated sawtooth wave. The sawtooth wave output from the sawtooth oscillator 142 is applied to a cathode input terminal 133.

The horizontal synchronizing signal H is supplied to a count input terminal CU of a counter 145, and the vertical synchronizing signal V is supplied to a reset input terminal RESET of the counter 145. The counter 145 applies its count output signal to a decoder 146. An X drive circuit 153 comprises a plurality of NPN transistors $T_{1X}' \ldots, T_{nX}$ having respective bases supplied with an output signal from the decoder 146, respective collectors connected to X grid input terminals 134 (see FIG. 14) and also to the reference voltage terminal −V1 through respective resistors $R_{1X}' \ldots, R_{nX}$ for pull-up, and respective emitters connected to a reference voltage terminal −V2 for pull-down.

Figure 16:
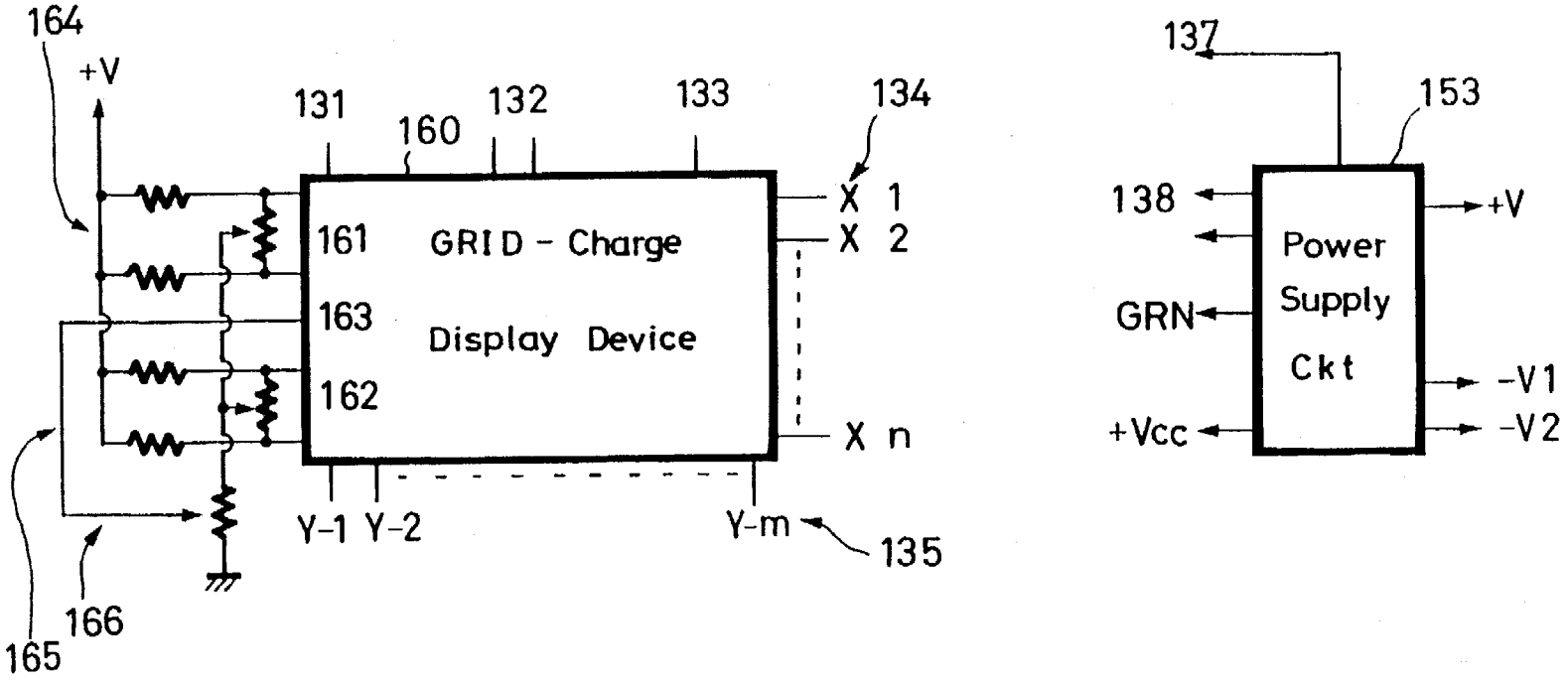
FIG. 16 is a block diagram of a television monitor which incorporates a grid-charge display device as an image display device according to a thirteenth embodiment of the present invention.

FIG. 16 shows in block form a television monitor which incorporates a grid-charge display device as an image display device according to a thirteenth embodiment of the present invention. The grid-charge display device, indicated by 160 in FIG. 16, differs from the grid-charge display device 130 shown in FIG. 14 in that it additionally includes X alignment input terminals 161, Y alignment input terminals 162, a focus input terminal 163, an X alignment adjuster 164, a Y alignment adjuster 165, and a focus adjuster 166. A power supply circuit 153 shown in FIG. 16 differs from the power supply circuit 136 shown in FIG. 14 in that it additionally has a reference voltage terminal +V.

A driving circuit of the television monitor shown in FIG. 16 is the same as the driving circuit shown in FIG. 15.

A binary-address-input grid-charge display device as an image display device according to another embodiment of the present invention will be described below. The binary-address-input grid-charge display device has a structure as shown in FIG. 1B and cross-sectional details as shown in FIG. 2A.

Basic operation of the binary-address-input grid-charge display device is the same as that of the grid-charge display devices described above. However, the binary-address-input grid-charge display device differs from the grid-charge display device in that it allows coordinates for charging grids to be entered with a binary code.

The binary-address-input grid-charge display device offers the following advantages: If an address decoder is produced at the same time that an X-Y grid assembly is manufactured, then since the number of electrode pins of the display device is reduced, the electrodes can be arranged at an IC pitch and a standard pitch of connectors or the like. This makes it easy to mount the display device on a printed-circuit board. With respect to the inputting of a binary code, by using two electrodes for normal and reversed levels for one digit, the electrodes can be of a simple structure composed of a resistor, a capacitor, and a diode. The process of and the equipment for manufacturing the display device are thus simplified and made inexpensive.

A process of manufacturing an X-Y grid assembly of a binary-address-input grid-charge display device will be described below. Those steps of the process which are identical to those of the manufacturing processes shown in FIGS. 12A through 12G and FIGS. 13A through 13G will not be described below. The manufacturing process differs from the manufacturing processes shown in FIGS. 12A through 12G and FIGS. 13A through 13G in that a photoresist is applied to an extension of a pattern matching the grid configuration shown in FIGS. 12A and 13A to leave grid address ground regions, that after the X and Y grids 120, 121 have been fabricated, a photoresist is coated on the address ground regions, and they are etched to expose the surfaces of contact regions according to grid numbers in FIGS. 12E, 12F and 13E, 13F, and in that after the semiconductor layers have been evaporated, address electrodes are attached in FIGS. 12E, 12F and 13E, 13F.

Figure 17A:
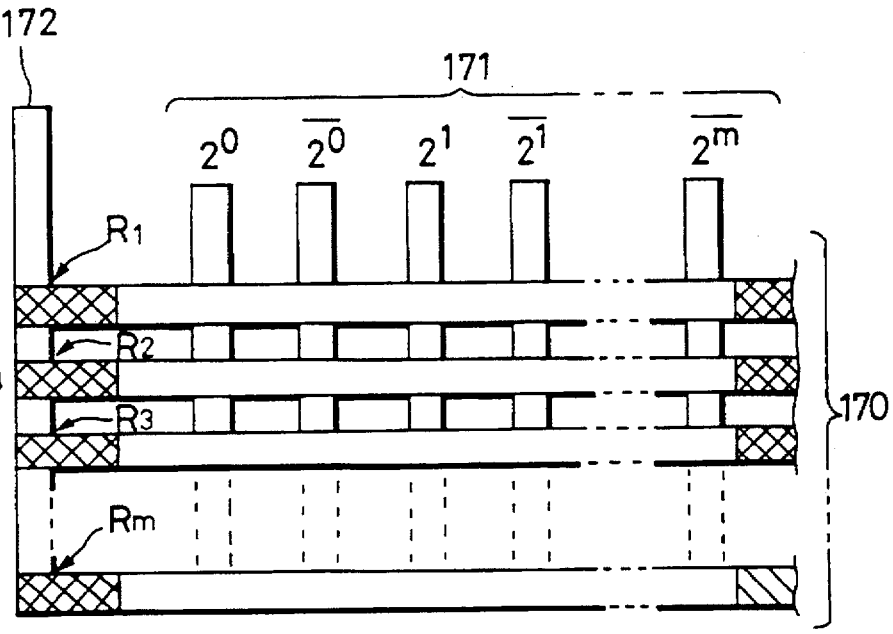
FIGS. 17A, 17B, and 17C are a fragmentary plan view, a fragmentary side elevational view, and a circuit diagram of an equivalent circuit, respectively, of a Y grid input section of a binary-address-input grid-charge display device as an image display device according to a fourteenth embodiment of the present invention.
Figure 17B:
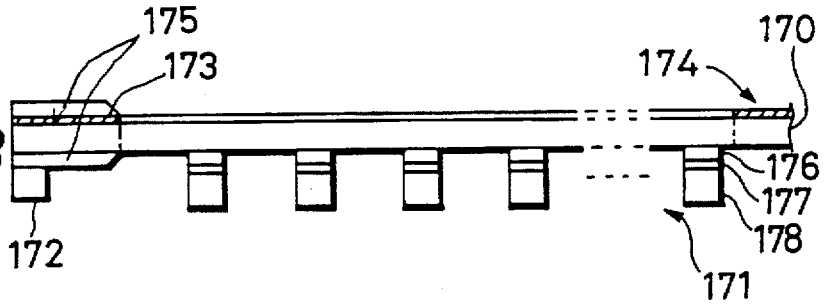
Figure 17C:
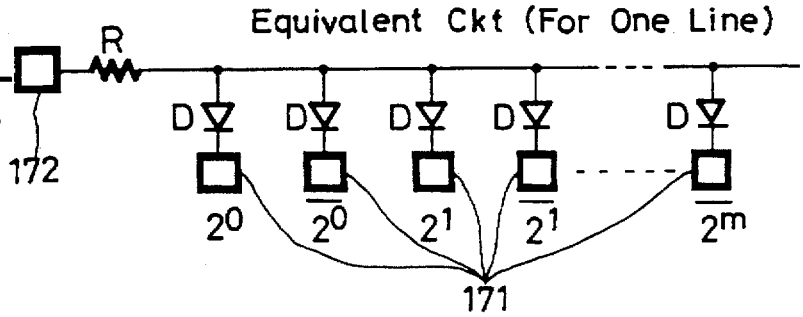

FIGS. 17A, 17B, and 17C show a Y grid input section of a binary-address-input grid-charge display device as an image display device according to a fourteenth embodiment of the present invention. In FIG. 17A, Y grid address input electrodes 171, paired for two binary digits for normal and reversed levels, are connected to a Y grid 170 in perpendicular relation thereto, and a brightness input electrode 172 is connected to the left-hand end of the Y grid 170.

In FIG. 17B, the upper surfaces of the opposite left- and right-hand ends of the Y grid 170 are covered with insulating layers 173, 174, respectively. A resistive film 175 is disposed on the insulating layer 173 on the left-hand end of the Y grid 170. The Y grid address input electrodes 171 comprise conductors 178, and P- and N-type semiconductor layers 176, 177 are disposed in the junction between the Y grid 170 and the Y grid address input electrodes 171.

In FIG. 17C, an equivalent circuit for one line of the Y grid input section includes a plurality of diodes D connected through a resistor R to the brightness input electrode 172 and also connected in a forward direction to the respective Y grid address input electrodes 171.

FIG. 18 is illustrative of operation of the Y grid of the binary-address-input grid-charge display device according to the fourteenth embodiment of the present invention. In the example shown in FIG. 18, binary code signals . . . 0001~ . . . 1000 are applied to the Y grid address input electrodes 171 with respect to Y grid lines 1~8 of the Y grid 170. If there are P- and N-type layers 176, 177 in the junction with the Y grid 170, then the mark X indicates no conduction, and if there are no P- and N-type layers 176, 177 in the junction with the Y grid 170, then the mark ○ indicates conduction.

Figure 19A:
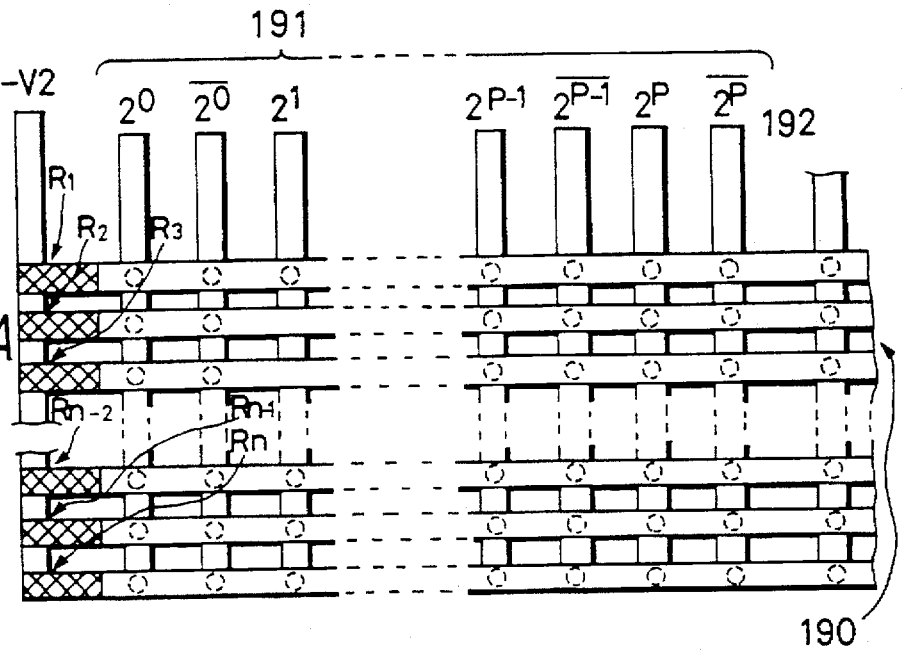
FIGS. 19A, 19B, and 19C a fragmentary plan view, a fragmentary side elevational view, and a circuit diagram of an equivalent circuit, respectively, of an X grid input section of the binary-address-input grid-charge display device according to the fourteenth embodiment of the present invention.
Figure 19B:
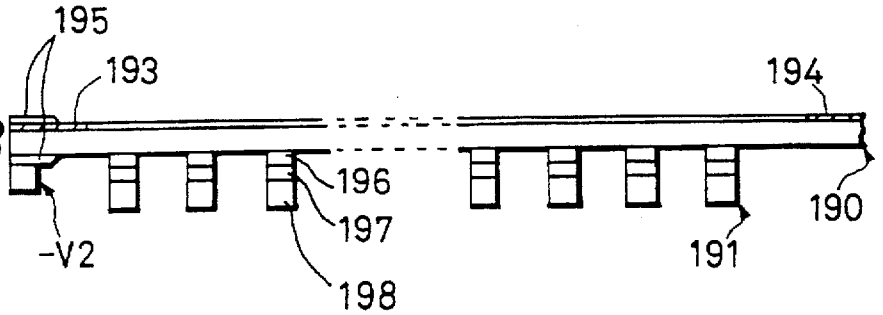
Figure 19C:
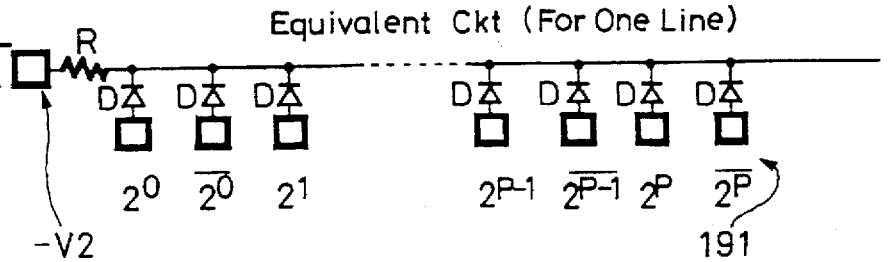

FIGS. 19A, 19B, and 19C show an X grid input section of the binary-address-input grid-charge display device according to the fourteenth embodiment of the present invention. In FIG. 19A, X grid address input electrodes 191, paired for two binary digits for normal and reversed levels, are connected to an X grid 190 in perpendicular relation thereto, and a reference voltage electrode –V2 is connected to the left-hand end of the X grid 190. A Y grid 192 is connected to the right-hand end of the X grid 190.

In FIG. 19B, the upper surfaces of the opposite left- and right-hand ends of the X grid 190 are covered with insulating layers 193, 194, respectively. A resistive film 195 is disposed on the insulating layer 193 on the left-hand end of the X grid 190. The X grid address input electrodes 191 comprise conductors 198, and P- and N-type semiconductor layers 196, 197 are disposed in the junction between the X grid 190 and the X grid address input electrodes 191.

In FIG. 19C, an equivalent circuit for one line of the Y grid input section includes a plurality of diodes D connected to the respective X grid address input electrodes 191 and also connected through a resistor R in a forward direction to the reference voltage electrode –V2.

FIG. 20 is illustrative of operation of the X grid of the binary-address-input grid-charge display device according to the fourteenth embodiment of the present invention. In the example shown in FIG. 20, binary code signals . . . 0001~ . . . 1000 are applied to the X grid address input electrodes 191 with respect to X grid lines 1~7 of the X grid 190. If there are P- and N-type layers 196, 197 in the junction with the Y grid 190, then the mark x indicates no conduction, and if there are no P- and N-type layers 196, 197 in the junction with the X grid 190, then the mark ○ indicates conduction.

Figure 21:
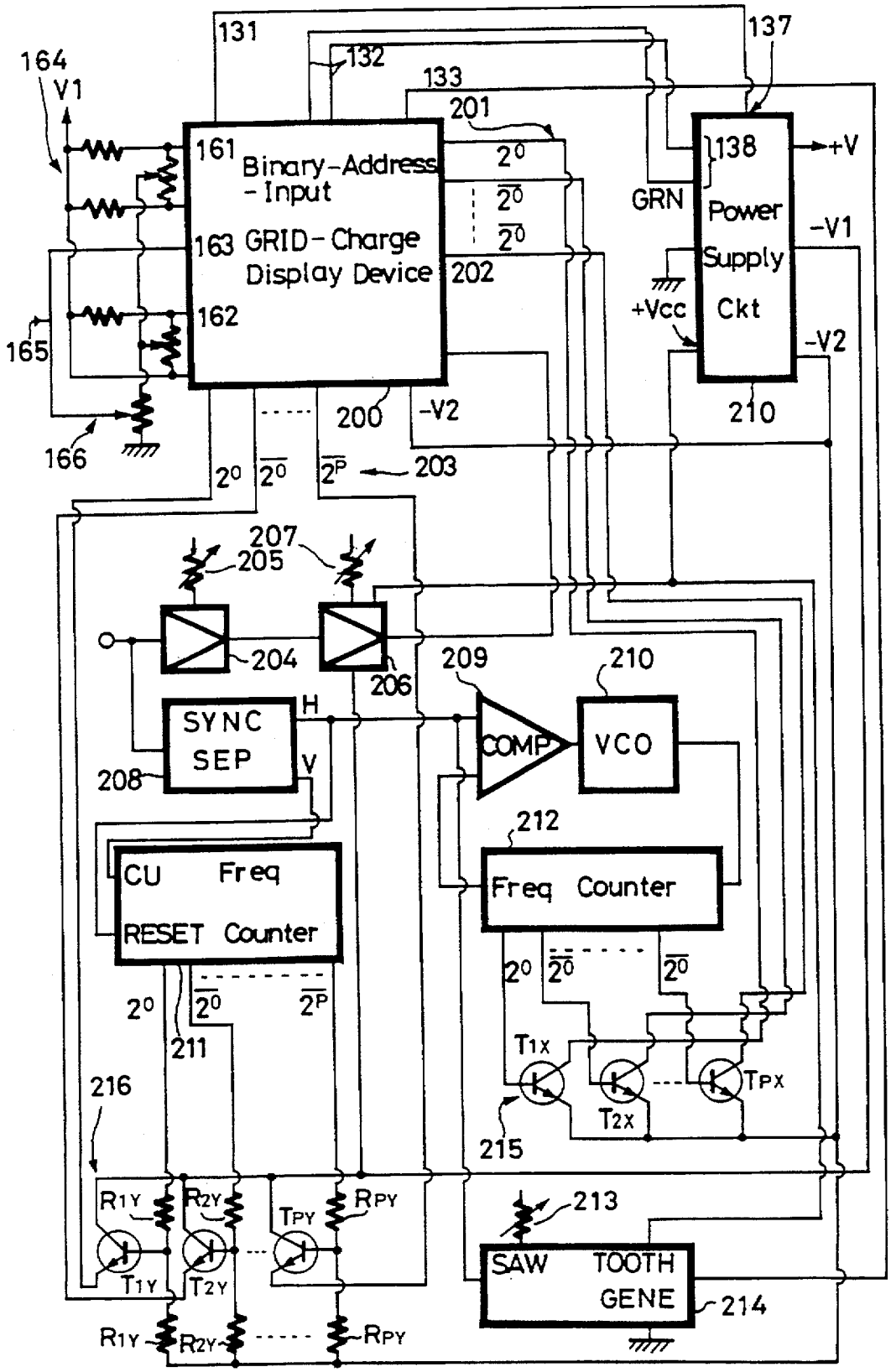
FIG. 21 is a circuit diagram of a driving circuit of a television monitor which incorporates a grid-charge display device as an image display device according to a fifteenth embodiment of the present invention.

FIG. 21 shows a driving circuit of a television monitor which incorporates a grid-charge display device as an image display device according to a fifteenth embodiment of the present invention. As shown in FIG. 21, the grid-charge display device, generally denoted by 200, has a high-voltage input terminal 131, heater input terminals 132, a cathode in-put terminal 133, an X alignment adjuster 164, X alignment input terminals 161, a Y alignment adjuster 165 and Y alignment input terminals 162, a focus adjuster 166, a focus input terminal 163, X address input terminals 201, Y address input terminals 203, a video signal input terminal 202, and a reference voltage terminal –V2.

A power supply circuit 210 has a high-voltage output terminal 137, heater power supply output terminals 138, a ground terminal GRN, a power supply voltage terminal +VCC, a reference voltage terminal +V1, a reference voltage terminal –V1, and a reference voltage terminal –V2.

In FIG. 21, a video signal supplied from a video signal input terminal VIDEO IN is amplified by an amplifier 204 having a contrast adjuster 205 and an amplifier 206 having a brightness adjuster 207, and then supplied to the video signal input terminal 202. The contrast and the brightness can be adjusted in the amplifiers 204, 206, respectively, by the contrast adjuster 205 and the brightness adjuster 207. The amplifier 206 is supplied with a power supply voltage from the power supply voltage terminal +VCC and also with a reference voltage from the reference voltage terminal –V1.

The video signal is also supplied to a synchronizing signal separator 208 which separates a horizontal synchronizing signal H and a vertical synchronizing signal V. The horizontal synchronizing signal H is applied to one of the input terminals of a phase comparator 209 whose output signal is supplied through a voltage-controlled oscillator 210 and a counter 212 to the other input terminal of the phase comparator 2093. The counter 212 applies its count output signal to an X drive circuit 215. The X drive circuit 215 comprises a plurality of NPN transistors $T_{1X}$, $T_{2X}$, . . . , $T_{qX}$ having respective bases supplied with the count output signal from the counter 212, respective emitters connected to the reference voltage terminal –V2 for pull-down, and respective collectors connected to the respective X address input terminals 201.

The horizontal synchronizing signal H is also supplied to a sawtooth generator 214 having a γ adjuster 213 which adjusts the linearity of a generated sawtooth wave to correct the γ curve of emitted light. The sawtooth wave output from the sawtooth generator 214 is supplied to the cathode input terminal 133. The sawtooth generator 214 is supplied with the power supply voltage from the power supply voltage terminal +VCC.

The vertical synchronizing signal V is supplied to a count input terminal CU of a counter 211, and the horizontal synchronizing signal H is supplied to a reset input terminal RESET of the counter 211. The counter 211 applies its count output signal to a Y drive circuit 216. The Y drive circuit 216 comprises a plurality of NPN transistors $T_{1Y}$, $T_{2Y}$, . . . , $T_{pY}$ having respective bases supplied with the count output signal from the counter 211 through respective resistors $R_{1Y}$, $R_{2Y}$, . . . , $R_{pY}$, respective collectors connected to the reference voltage terminal –V1 for pull-up, and respective emitters connected to the Y address input terminals 203. The bases of the NPN transistors $T_{1Y}$, $T_{2Y}$, . . . , $T_{pY}$ are also connected through respective resistors $R_{1Y}'$, $R_{2Y}'$, . . . , $R_{pY}'$ to the reference voltage terminal –V2.

Figure 22:
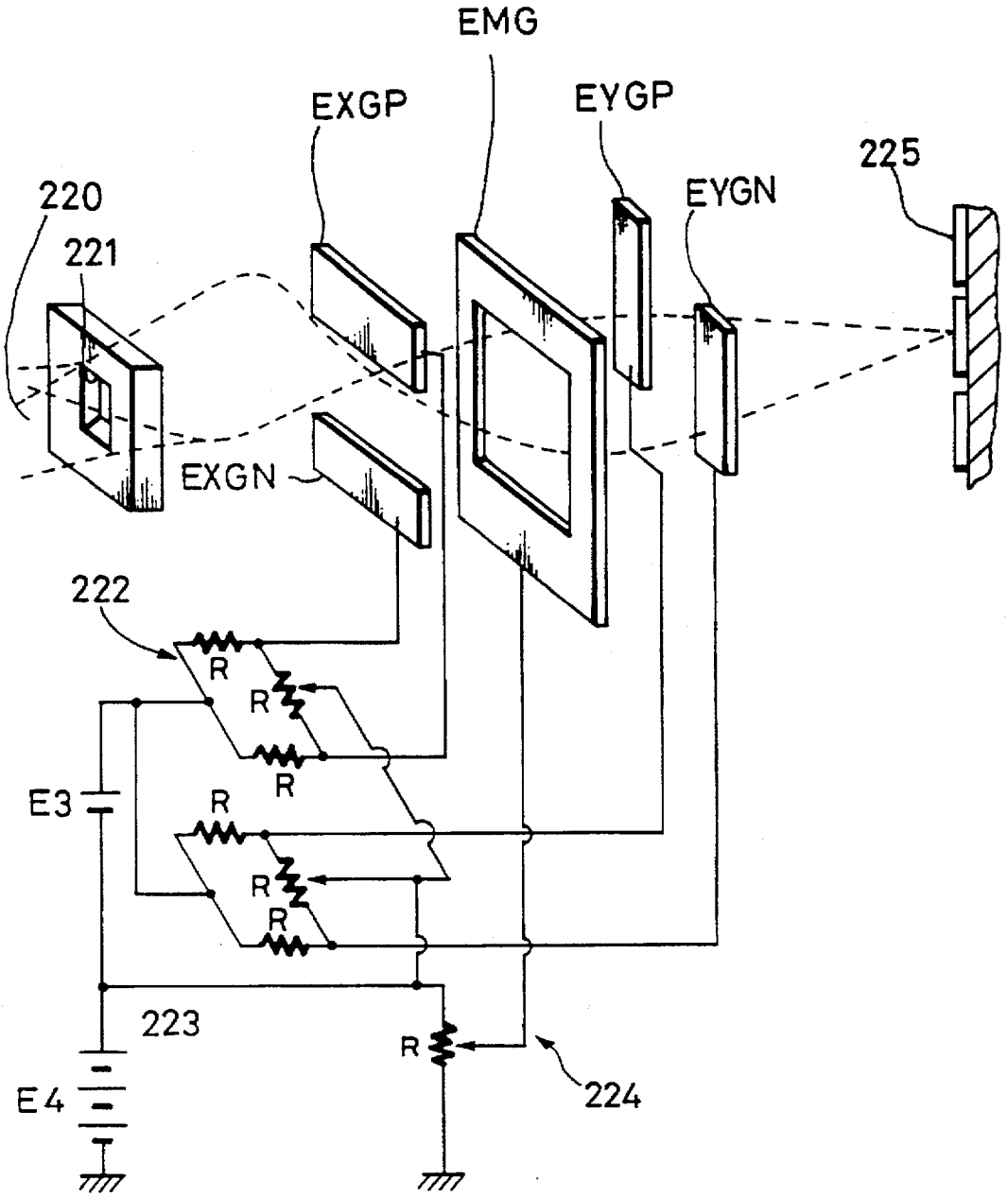
FIG. 22 is a perspective view, partly in circuit diagram, showing convergence and alignment of an electron beam with a bright spot in a grid-charge display device as an image display device according to a sixteenth embodiment of the present invention.

FIG. 22 shows convergence and alignment of an electron beam with a bright spot in a grid-charge display device as an image display device according to a sixteenth embodiment of the present invention. In FIG. 22, after having passed through an electron passage hole 221, an electron beam 220 passes between an upper X alignment electrode EXGP and a lower X alignment electrode EXGN which comprise horizontally elongate plates, respectively, that are vertically spaced from each other. A predetermined voltage difference is developed between the upper X alignment electrode EXGP and the lower X alignment electrode EXGN by an X alignment circuit 222 which comprises a smaller power supply E3, a larger power supply E4, and a plurality of resistors R, for finely adjusting the travel of the electron beam vertically, i.e., in an X direction, for vertical alignment on a phosphor layer 225.

The electron beam that has passed between the upper X alignment electrode EXGP and the lower X alignment electrode EXGN then passes through a focus electrode EMG in the form of a square frame. The focus electrode EMG is supplied with a predetermined voltage from a focus circuit 224 comprising the larger power supply E4 and a resistor R, for converging the electron beam.

The electron beam that has passed through the focus electrode EMG passes between a left Y alignment electrode EYGP and a right Y alignment electrode EYGN which comprise vertically elongate plates, respectively, that are horizontally spaced from each other. A predetermined voltage difference is developed between the left Y alignment electrode EYGP and the right Y alignment electrode EYGN by a Y alignment circuit 223 which comprises the smaller power supply E3, the larger power supply E4, and a plurality of resistors R, for finely adjusting the travel of the electron beam horizontally, i.e., in a Y direction, for horizontal alignment on the phosphor layer 225.

The upper X alignment electrode EXGP, the lower X alignment electrode EXGN, the left Y alignment electrode EYGP, and the right Y alignment electrode EYGN jointly provide a three-layer electron lens serving as convergence grids for adjusting light emission per pixel on the phosphor layer 225. The electron beam may be adjusted for variable alignment in as small intervals as the pitch of the phosphor layer 225.

Figures 23A, 23B, 23C:
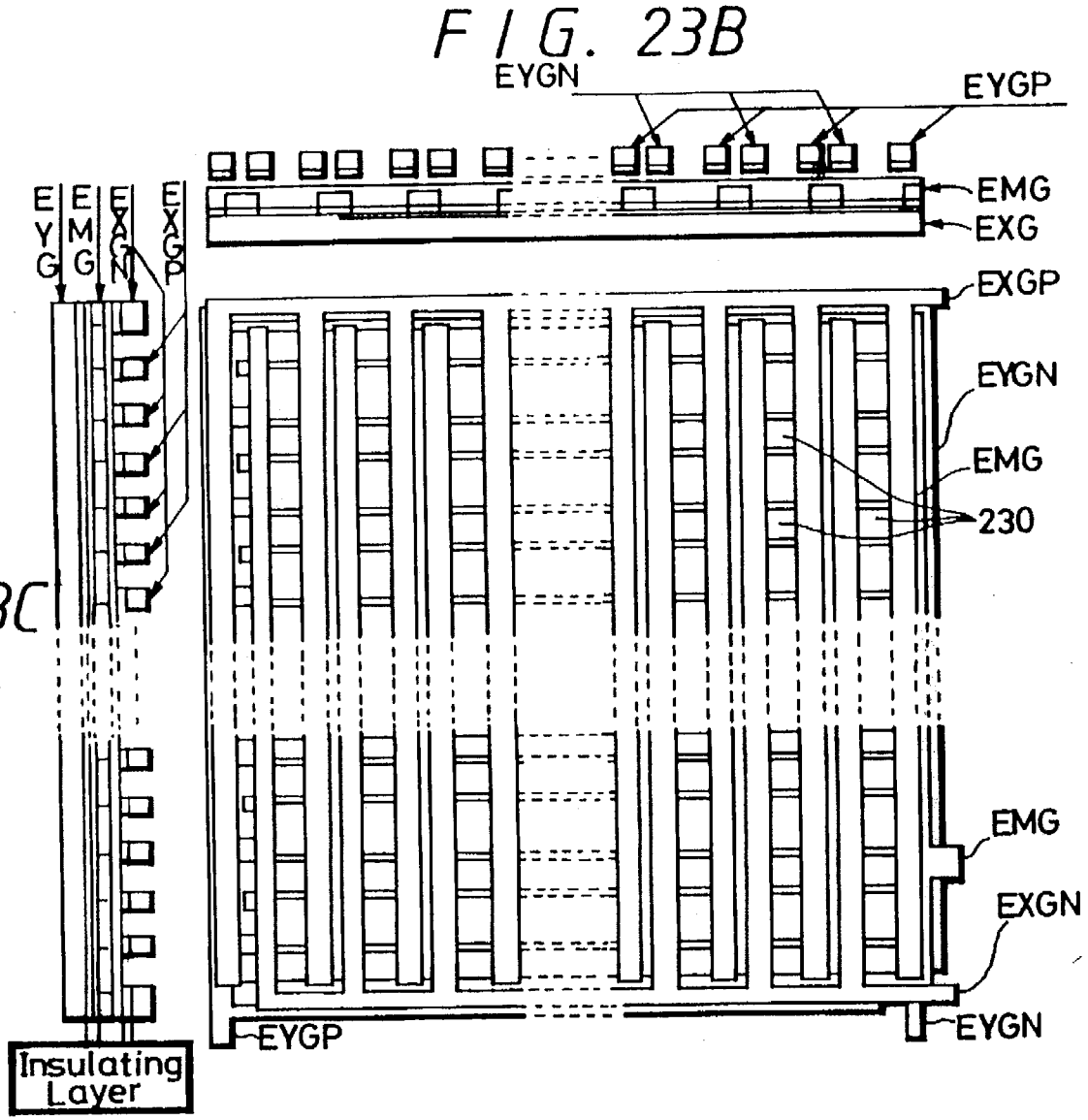
FIGS. 23A, 23B, and 23C are front elevational, plan, and left-hand side elevational views, respectively, of the structure of convergence grids of a grid-charge display device as an image display device according to a seventeenth embodiment of the present invention.

FIGS. 23A, 23B, and 23C show the structure of convergence grids of a grid-charge display device as an image display device according to a seventeenth embodiment of the present invention. As shown in FIGS. 23A, 23B, and 23C, an upper X alignment electrode EXGP and a lower X alignment electrode EXGN, each of a comb shape, are combined in inter-digitating relation to each other. A left Y alignment electrode EYGP and a right Y alignment electrode EYGN, each of a comb shape, extend perpendicularly to the upper X alignment electrode EXGP and the lower X alignment electrode EXGNr and are combined in interdigitating relation to each other. A focus electrode EMG is sandwiched between the upper and lower X alignment electrodes EXGP, EXGN and the left and right Y alignment electrodes EYGP, EYGN.

Figure 24A:
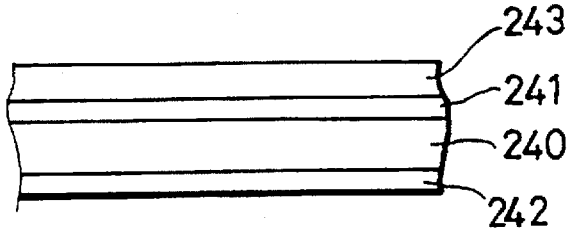
FIGS. 24A through 24E are views showing a process of manufacturing convergence grids of a grid-charge display device as an image display device according to an eighteenth embodiment of the present invention.
Figure 24B:
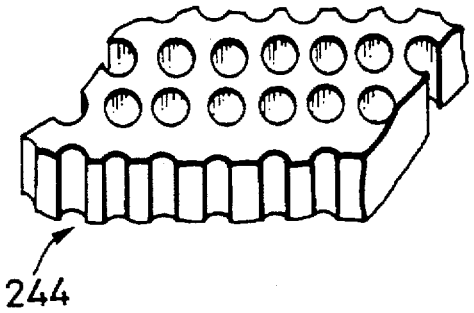

FIGS. 24A through 24E show a process of manufacturing convergence grids of a grid-charge display device as an image display device according to an eighteenth embodiment of the present invention. As shown in FIG. 24A, a photosensitive resist 243 is coated on an aluminum plate 240 whose opposite surfaces have been insulated by respective anodized layers (Alumite) 241, 242. In FIG. 24B, a mask for passing light only in regions corresponding to electron passage holes 244 is placed over the photosensitive resist 243, and the photosensitive resist 243 is exposed to light through the mask. The photosensitive resist 243 is then removed from those regions corresponding to electron passage holes 244, and the aluminum plate 240 is etched to form electron passage holes 244 therein.

Figure 24C:
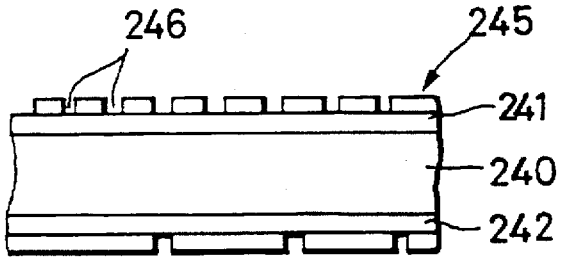
Figure 24D:
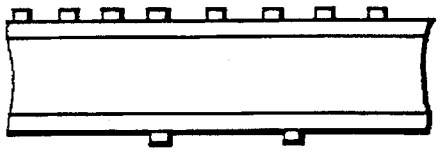
Figure 24E:
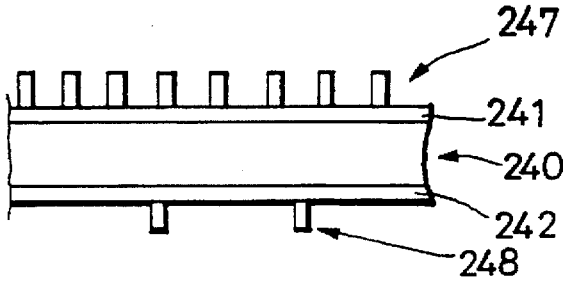

In FIG. 24C, a deflection pattern mask 245 is placed on a pattern surface 246 and also on an opposite surface, and aluminum is deposited on only the pattern surface 246 by vacuum evaporation. In FIG. 24D, the deflection pattern mask 245 is removed. In FIG. 24E, the pattern surface 246 is plated to form copper layers 247, 248 of a required thickness.

In a grid-charge display device with no discharge circuit, variations of capacitors C in grids corresponding to bright spots may directly affect variations in brightness. To minimize such a drawback, a grid-charge display device may have a discharge circuit.

Figure 25:
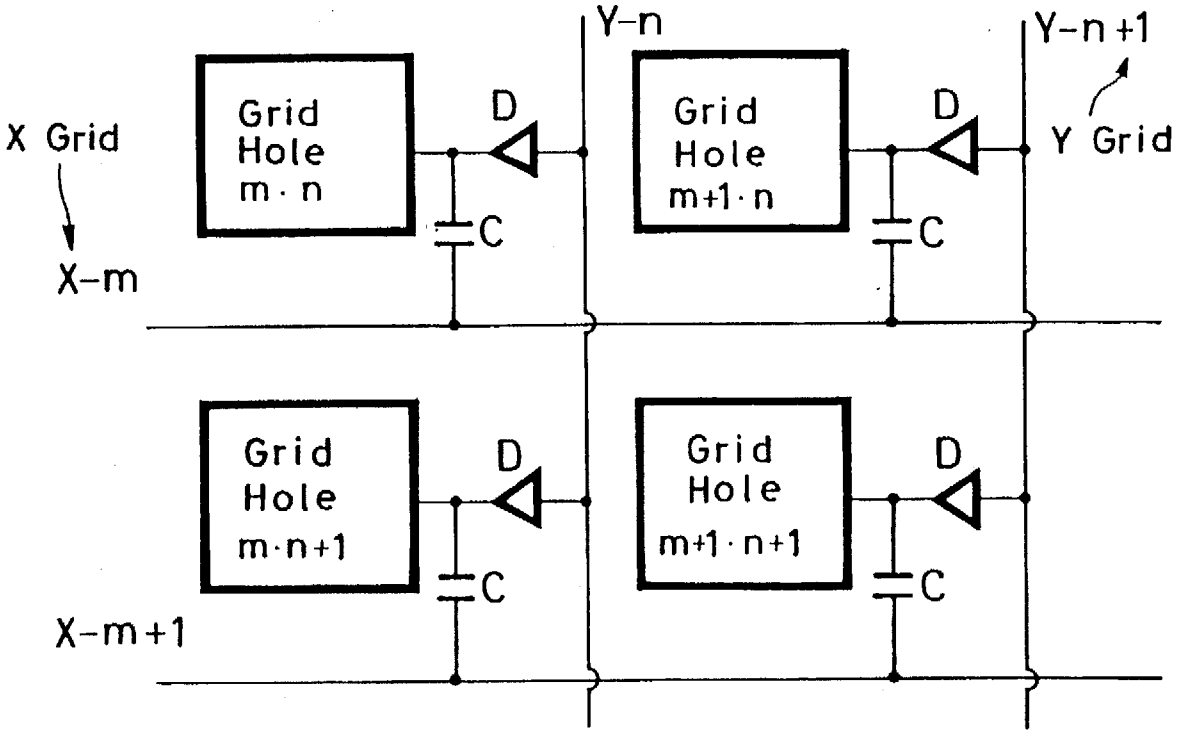
FIG. 25 is a fragmentary circuit diagram of an equivalent circuit without a discharging circuit of a grid-charge display device as an image display device according to the present invention.

FIG. 25 shows an equivalent circuit without a discharging circuit of a grid-charge display device as an image display device according to the present invention. In FIG. 25, a grid hole m·n defined between a Y grid line Y-n and an X grid line X-m is associated with a diode D and a capacitor C connected in a forward direction from the Y grid line Y-n toward the X grid line X-m, and a grid hole m·n+1 defined between the Y grid line Y-n and an X grid line X-m+1 is associated with a diode D and a capacitor C connected in a forward direction from the Y grid line Y-n toward the X grid line X-m+1.

Similarly, a grid hole m+1·n defined between a Y grid line Y-n+1 and the X grid line X-m is associated with a diode D and a capacitor C connected in a forward direction from the Y grid line Y-n+1 toward the X grid line X-m, and a grid hole m+1·n+1 defined between the Y grid line Y-n+1 and the X grid line X-m+1 is associated with a diode D and a capacitor C connected in a forward direction from the Y grid line Y-n+1 toward the X grid line X-m+1.

Figure 26:
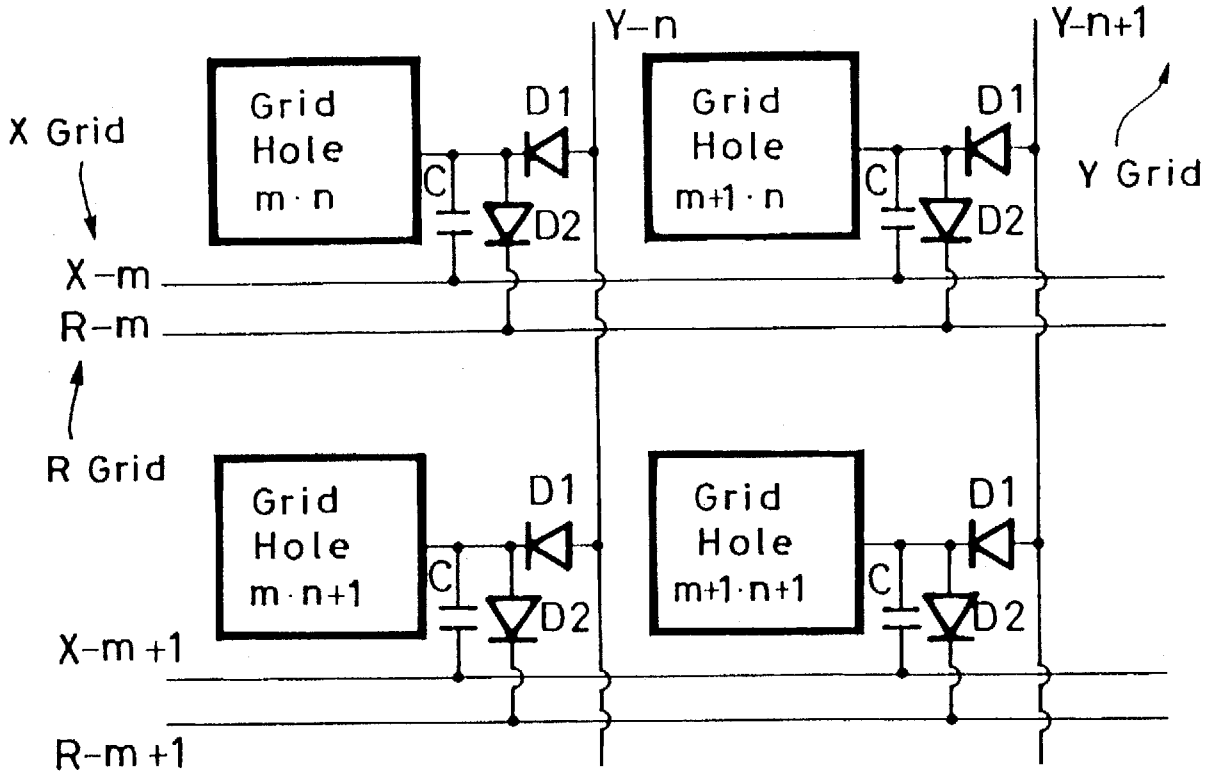
FIG. 26 is a fragmentary circuit diagram of an equivalent circuit with a discharging circuit of a grid-charge display device as an image display device according to the present invention.

FIG. 26 shows an equivalent circuit with a discharging circuit of a grid-charge display device as an image display device according to the present invention. In FIG. 26, a grid hole m·n defined between a Y grid line Y-n and an X grid line X-m is associated with a diode D1 and a capacitor C connected in a forward direction from the Y grid line Y-n toward the X grid line X-m, and a diode D2 is connected in a forward direction from the Y grid line Y-n toward an R grid line R-m. A grid hole m·n+1 defined between the Y grid line Y-n and an X grid line X-m+1 is associated with a diode D1 and a capacitor C connected in a forward direction from the Y grid line Y-n toward the X grid line X-m+1, and a diode D2 is connected in a forward direction from the Y grid line Y-n toward an R grid line R-m+1.

Similarly, a grid hole hole m+1·n defined between a Y grid line Y-n+1 and the X grid line X-m is associated with a diode D1 and a capacitor C connected in a forward direction from the Y grid line Y-n+1 toward the X grid line X-m, and a diode D2 is connected in a forward direction from the Y grid line Y-n+1 toward the R grid line R-m. A grid hole m+1·n+1 defined between the Y grid line Y-n+1 and the X grid line X-m+1 is associated with a diode D1 and a capacitor C connected in a forward direction from the Y grid line Y-n+1 toward the X grid line X-m+1, and a diode D2 is connected in a forward direction from the Y grid line Y-n+1 toward the R grid line R-m+1.

Figure 27:
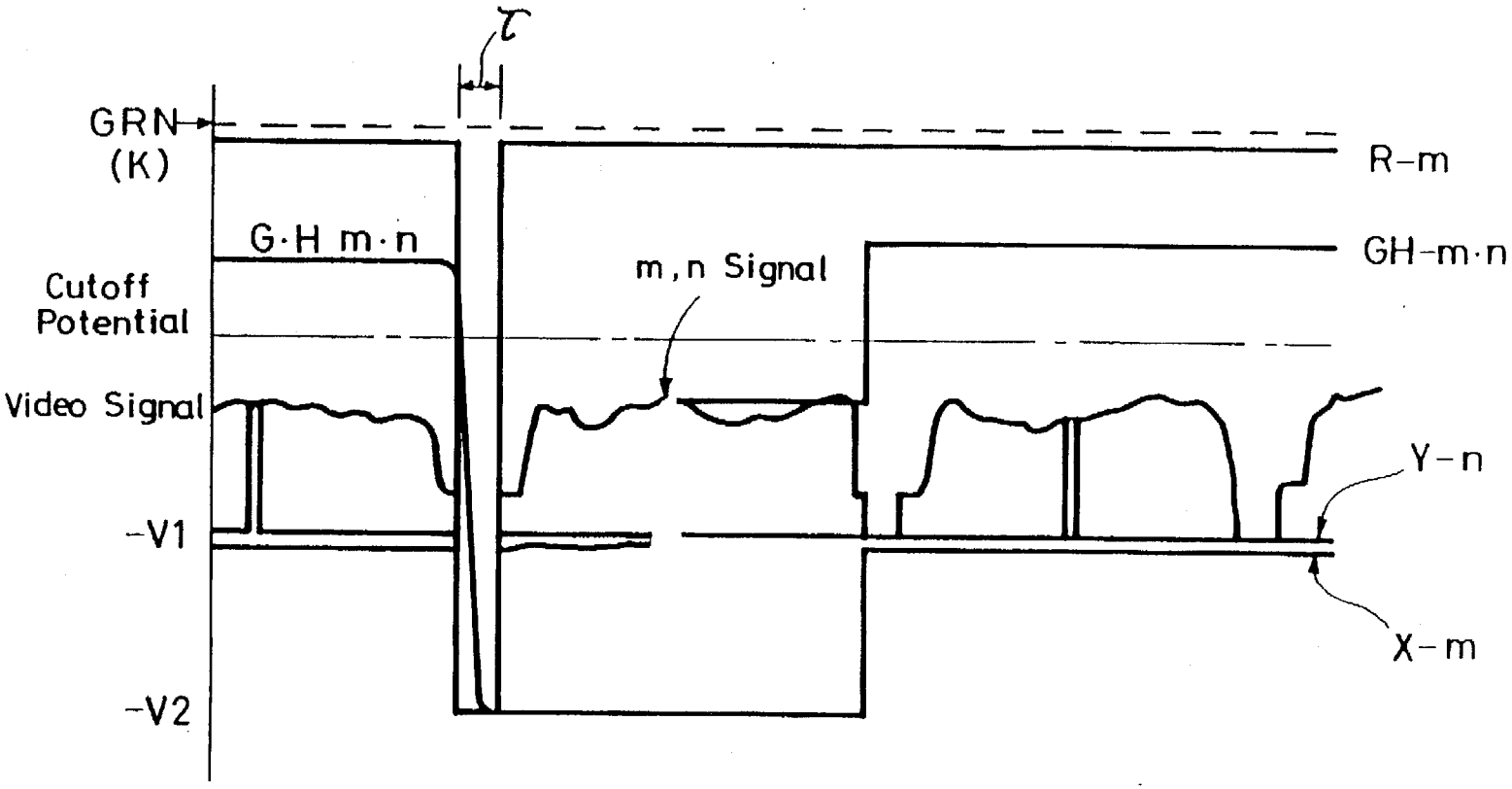
FIG. 27 is a diagram showing control operation of a grid assembly with a discharging circuit of a grid-charge display device as an image display device according to the present invention.

FIG. 27 shows control operation of a grid assembly with a discharging circuit of a grid-charge display device as an image display device according to the present invention. In FIG. 27, a voltage on a X grid line X-m is set to −V2 during an Mth horizontal period of a video signal and kept at −V1 during the other period of the video signal. A voltage on a Y grid line Y-n is set to a video signal level at an nth clock pulse in plural divisions of one horizontal period, and kept at −V1 during the other period.

A voltage on an R grid line R-m with a discharging circuit is kept at −V2 during a period $\tau$ immediately after a negative-going edge of the Mth horizontal period of the video signal, and kept at a potential higher than the maximum potential of the grid hole, i.e., substantially at a ground potential GRN. The potentials −V2, −V1, a cutoff potential, and the ground potential GRN are not absolute potentials, but relative potentials which are determined as values inherent in the grid-charge display device.

Since the discharging circuit is added to discharge the R grid, variations of the capacitors C can be eliminated.

Figure 28A:
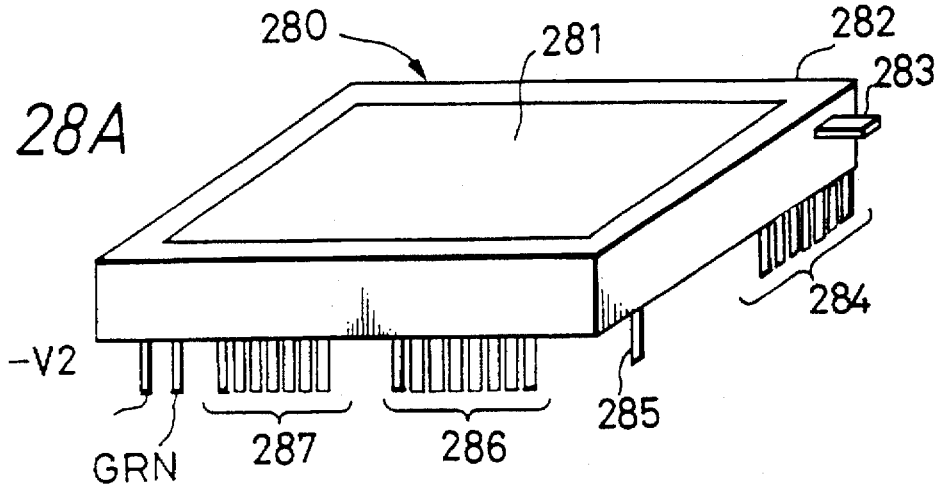
FIG. 28A is a perspective view of a grid-charge display device having a charge control grid assembly with a discharging circuit, as an image display device according to a nineteenth embodiment of the present invention.

FIG. 28A shows a grid-charge display device having a charge control grid assembly with a discharging circuit, as an image display device according to a nineteenth embodiment of the present invention. As shown in FIG. 28A, the grid-charge display device, denoted by 280, has a rectangular frame 282 and a planar display panel 281 surrounded by and attached to an upper end of the frame 282. An anode 283 is connected to the display panel 281 for applying a high voltage to the display panel 281.

An X address grid 286, a reference voltage terminal −V2, a ground terminal GRN, and an R address grid 287 are attached to the lower end of a first side of the frame 282, and a Y address grid 284 and a video signal input terminal 285 are attached to the lower end of a second side of the frame 282.

The grid-charge display device 280 shown in FIG. 28A differs from the binary-address-input grid-charge display device 10 shown in FIG. 1B in that the ground terminal GRN and the R address grid 287 are added.

Figure 28B:
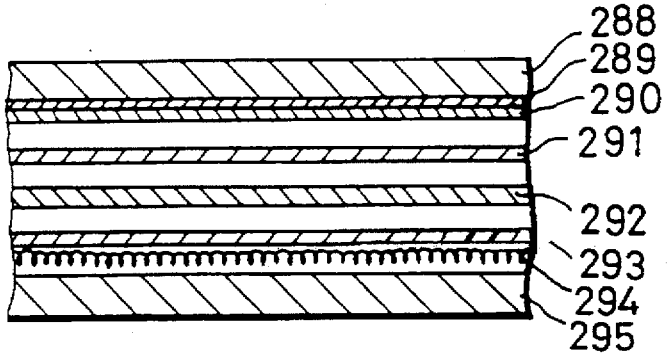
FIG. 28B is a fragmentary cross-sectional view of the grid-charge display device shown in FIG. 28A.

FIG. 28B shows in cross section the grid-charge display device 280 shown in FIG. 28A. As shown in FIG. 28B, the grid-charge display device 280 has a face glass panel 288 on its top and a phosphor layer 289 disposed underneath the surface glass panel 288 and sandwiched between the face glass panel 288 and a metal back anode 290.

The grid-charge display device 280 also includes a focus and alignment grid 291 spaced a certain distance from the metal back anode 290, a charge control grid assembly 292 spaced a certain distance from the focus and alignment grid 291, a cathode 293 spaced a certain distance from the charge control grid assembly 292, a heater 294 spaced a certain distance from the cathode 293, and a back glass panel 295 spaced a certain distance from the heater 294 and disposed on the lowermost side of the display device. Each of the above components of the grid-charge display device 280 is of a planar shape. All the electrodes are sealed in a vacuum. Light emitted by the grid-charge display device 280 is discharged through the face glass panel 288.

Figure 28C:
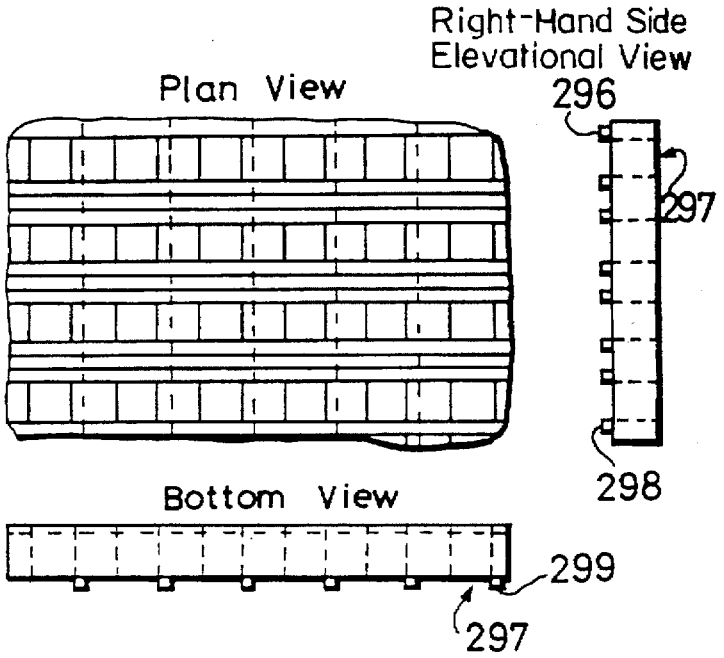
FIG. 28C is a set of plan, right-hand side elevational, and bottom views of the charge control grid assembly of the grid-charge display device shown in FIG. 28A.

FIG. 28C shows the charge control grid assembly 292 of the grid-charge display device shown in FIG. 28A. The charge control grid assembly 292 has an X grid 298, an R grid 296, and a Y grid 299, each in the form of a planar grid. The X grid 298 and the R grid 296, and the Y grid 299 are combined with each other in orthogonal relation, defining electron passage holes (grid holes) 297 at junctions thereof.

Figure 29B:
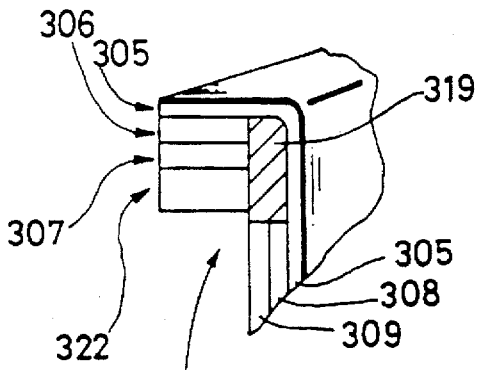
FIG. 29B is an enlarged fragmentary view of the charge control grid assembly shown in FIG. 29A.
Figure 29C:
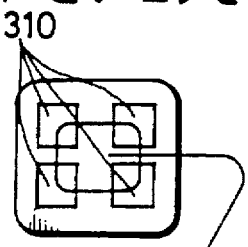
FIG. 29C is a plan view of the charge control grid assembly shown in FIG. 29A.
Figure 29A:
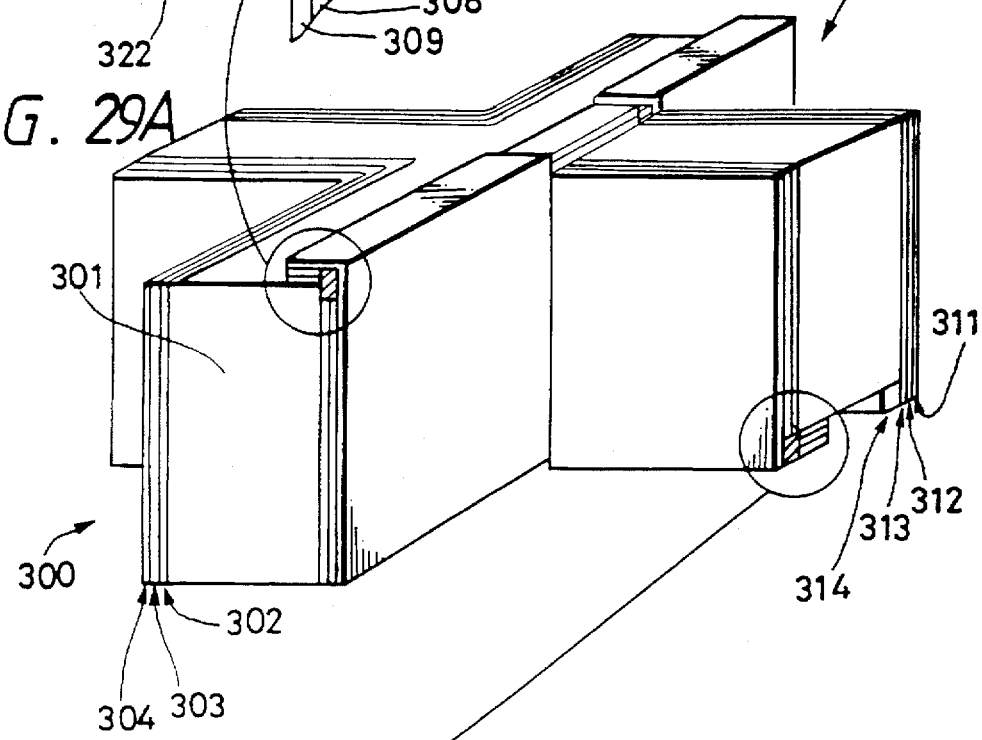
FIG. 29A is a perspective view of a charge control grid assembly of a grid-charge display device with a discharging circuit, as an image display device according to a twentieth embodiment of the present invention.
Figure 29D:
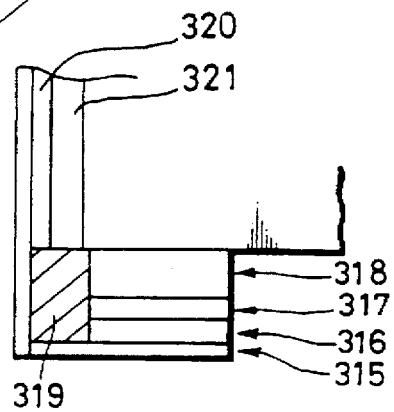
FIG. 29D is an enlarged fragmentary view of the charge control grid assembly shown in FIG. 29A.

FIG. 29A illustrates a charge control grid assembly of a grid-charge display device with a discharging circuit, as an image display device according to a twentieth embodiment of the present invention. FIGS. 29B, 29C, and 29D also show the charge control grid assembly shown in FIG. 29A. As shown in FIG. 29A, the charge control grid assembly, generally denoted by 300, comprises a good conductor layer 302 as a cathode of a capacitor C, a dielectric layer 303, and a good conductor 304 as an anode of the capacitor C, i.e., a surface of a grid hole, which are disposed on one side of a base 301.

As shown in FIG. 29B, an N-type layer 306, a P-type layer 307, a Y grid 322, a good conductor 305, a dielectric layer 308, and a good conductor 309 are positioned on an upper end of another side of the base 301 and located inwardly of a good conductor 305 with an insulating member 309 interposed therebetween.

As shown in FIG. 29D, a good conductor 321, a dielectric layer 312, an R grid 318, an N-type layer 317, and a P-type layer 316 are positioned on a lower end of another side of the base 301 and located inwardly of a good conductor 315 with an insulating member 319 interposed therebetween.

As shown in FIG. 29A, a dielectric layer 312, a good conductor 313 as a cathode of a capacitor C, and an X grid 314 are disposed on a lower end of another side of the base 301 and located inwardly of a good conductor 311 as an anode of a capacitor C.

Electron passage holes 310 are defined in the charge control grid assembly as shown in FIG. 29C.

Each of the grid-charge display devices according to the present invention can be used in a wall-mounted television receiver, a display unit of a desktop personal computer, a monitor television set for outdoor use, an ultralarge television set, a road map panel, a car-mounted television monitor, or the like.

In each of the above embodiments, capacitive bodies C are disposed at the junctions of X and Y grids as planar two-layer conductive grids which have electron passage holes 30 in an X-Y grid assembly 24 as a control electrode. A control voltage for controlling electrons emitted from a cathode 25 as a planar cathode is stored in the capacitive bodies C, and the electrons are controlled by the stored control voltage to be applied to a phosphor layer 21 as a light emitting layer for emitting light therefrom. Since electrons are supplied at all times by the control voltage, the light emitting layer can continuously emit light, and the potential of an anode 22 as a high-voltage electrode can be lowered. The components can be composed of planar members. Therefore, the image display device is lightweight and is of a low profile.

Since the cathode 35 as a planar cathode, the X-Y grid assembly 24 as a control electrode, and the anode 22 as a high-voltage electrode jointly constitute a triode, the image display device is simple in structure, can easily be increased in size, and can be manufactured inexpensively by relatively simple equipment.

An accelerating electrode for accelerating electrons is disposed between the X-Y grid assembly 24 as a control electrode and the anode 22 as a high-voltage electrode. The cathode 25, the X-Y grid assembly 24, the accelerating electrode, and the anode 22 jointly constitute a tetrode. The accelerating electrode is effective to increase the number of supplied electrons for brighter emission of light.

A convergence electrode 23 for converging electrons and an alignment electrode as an adjusting electrode for adjusting the direction of electrons are disposed between the X-Y grid assembly 24 as a control electrode and the anode 22 as a high-voltage electrode. The cathode 25, the X-Y grid assembly 24, the convergence electrode 23 and the alignment electrode, and the anode 22 jointly constitute a pentode. The convergence electrode 23 and the alignment electrode are effective to make the electrons more convergent for thereby controlling the electrons into alignment with pixels.

An auxiliary cathode is disposed as a coated layer of magnesium oxide on the cathode 25, and a negative voltage may be applied to the cathode 25 to cause the auxiliary cathode to emit secondary electrons thereby to increase the quantity of emitted electrons. In such an arrangement, the electron density around the cathode 25 can be made uniform for increasing the quantity of emitted electrons.

A medium-potential sawtooth drive voltage D whose minimum potential is zero volt is applied to a cathode 73 which serves as a planar cathode for emitting electrons from its entire planar surface, producing capacitive bodies C at the junctions of planar two-layer conductive grids with electron passage holes 30 defined at the junctions. Low-potential control voltages B', E' of at least negative levels are applied to control electrodes 71, 72 for controlling electrons supplied from the planar cathode 73, and a flat high-potential voltage A is applied to an anode 70 as a high-voltage electrode to attract electrons that have passed through the electron passage holes 30 in the X and Y grids 71, 72. Therefore, the linearity of brightness at the light emitting layer which emits light upon bombardment of electrons can be adjusted.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. An image display device, comprising:

a planar cathode for emitting electrons from substantially an entire planar surface thereof;

a control electrode having two layers, each of said two layers being composed of a planar conductive grid which together define a plurality of co-planar electron passage holes at a respective plurality of junctions thereof, said control electrode having a plurality of capacitive bodies disposed at said plurality of junctions for storing a control voltage to control the electrons emitted from said planar cathode and passing through said plurality of co-planar electron passage holes;

a planar light emitting layer; and a high-voltage electrode for applying a high voltage to said planar light emitting layer to attract the electrons that have passed through said plurality of co-planar electron passage holes and have been controlled by said control voltage to said planar light emitting layer for emitting light in response to bombardment of the electrons thereon.

2. The image display device according to claim 1, wherein said planar cathode, said control electrode, and said high-voltage electrode jointly constitute a triode.

3. The image display device according to claim 1, further comprising:

an accelerating electrode disposed between said control electrode and said high-voltage electrode for accelerating the electrons, wherein said planar cathode, said control electrode, said accelerating electrode, and said high-voltage electrode jointly constitute a tetrode.

4. The image display device according to claim 1, further comprising:

a convergence electrode for converging the electrons that have passed through said plurality of co-planar electron passage holes; and an adjusting electrode for adjusting the direction of the electrons that have passed through said plurality of co-planar electron passage holes, wherein said convergence electrode and said adjusting electrode are disposed between said control electrode and said high-voltage electrode and wherein said planar cathode, said adjusting electrode, and said high-voltage electrode jointly constitute a pentode.

5. An image display device according to claim 1, further comprising an auxiliary cathode disposed as a coated layer of magnesium oxide on said planar cathode, wherein a negative voltage is applied to said planar cathode to emit secondary electrons from said auxiliary cathode for increasing an amount of emitted electrons.

6. A method of driving an image display device, comprising the steps of:

applying a sawtooth drive voltage having a predetermined maximum potential and a minimum potential of zero volts to a planar cathode for emitting electrons from substantially an entire planar surface thereof;

applying a voltage of a predetermined negative level to a control electrode composed of two planar conductive grids, which together define a plurality of co-planar electron passage holes at a respective plurality of junctions thereof, said control electrode having capacitive bodies disposed at said plurality of junctions for storing a control voltage to control the electrons emitted from said planar cathode and passing through said plurality of co-planar electron passage holes; and applying a high-potential voltage greater than said predetermined maximum potential to a high-voltage electrode to attract the electrons which have passed through said plurality of co-planar electron passage holes.

7. A method of driving an image display device, comprising the steps of:

applying a sawtooth drive voltage having a predetermined maximum potential and a minimum potential of zero volts to a planar cathode for emitting electrons from substantially an entire planar surface thereof;

applying a voltage of a predetermined negative level to a control electrode composed of two planar conductive grids, which together define a plurality of co-planar electron passage holes at a respective plurality of junctions thereof, said control electrode having a plurality of capacitive bodies disposed at said plurality of junctions for storing a control voltage to control the electrons emitted from said planar cathode and passing through said plurality of co-planar electron passage holes;

applying an accelerating voltage greater than said predetermined maximum potential to an accelerating electrode to accelerate the electrons which have passed through said plurality of co-planar electron passage holes; and applying a high-potential voltage greater than said accelerating voltage to a high-voltage electrode to attract the electrons which have passed through said plurality of co-planar electron passage holes and have been accelerated by said accelerating electrode.

8. A method of driving an image display device, comprising the steps of:

applying a sawtooth drive voltage having a predetermined maximum potential and a minimum potential of zero volts to a planar cathode for emitting electrons from substantially an entire planar surface thereof;

applying a voltage of a predetermined negative level to a control electrode composed of two planar conductive grids, which together define a plurality of co-planar electron passage holes at a respective plurality of junctions thereof, said control electrode having a plurality of capacitive bodies disposed at said plurality of junctions for storing a control voltage to control the electrons emitted from said planar cathode and passing through said plurality of co-planar electron passage holes;

applying a convergence voltage greater than said predetermined maximum potential to a convergence electrode to converge the electrons which have passed through said plurality of co-planar electron passage holes;

applying an adjusting voltage greater than said predetermined maximum potential to an adjusting electrode to adjust the direction of the electrons which have passed through said plurality of co-planar electron passage holes and which have been converged by said converging electrode; and applying a high-potential voltage greater than said adjusting voltage to a high-voltage electrode to attract the electrons which have been converged by said convergence electrode and adjusted by said adjusting electrode.

* * * * *